US010211547B2

(12) United States Patent
Burris et al.

(10) Patent No.: US 10,211,547 B2
(45) Date of Patent: Feb. 19, 2019

(54) COAXIAL CABLE CONNECTOR

(71) Applicant: Corning Optical Communications RF LLC, Glendale, AZ (US)

(72) Inventors: Donald Andrew Burris, Peoria, AZ (US); Jimmy Valentin Falster, Vordingborg (DK); Michael Ole Matzen, Vordingborg (DK); Michael Meister, Langebaek (DK); Thomas Dewey Miller, Peoria, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days.

(21) Appl. No.: 14/844,592

(22) Filed: Sep. 3, 2015

(65) Prior Publication Data

US 2017/0069982 A1 Mar. 9, 2017

(51) Int. Cl.
*H01R 9/05* (2006.01)
*H01R 43/16* (2006.01)

(52) U.S. Cl.
CPC ..... *H01R 9/05* (2013.01); *H01R 9/0524* (2013.01); *H01R 43/16* (2013.01)

(58) Field of Classification Search
CPC ..... H01R 9/0518; H01R 13/59
(Continued)

(56) References Cited

U.S. PATENT DOCUMENTS 331,169 A 11/1885 Thomas
346,958 A 8/1886 Stone
(Continued)

FOREIGN PATENT DOCUMENTS

CA 2096710 11/1994
CN 1210379 3/1999
(Continued)

OTHER PUBLICATIONS

European Search Report dated Apr. 8, 2015 pertaining to European Patent Application No. 13733586.5.
(Continued)

*Primary Examiner* — Tulsidas C Patel
*Assistant Examiner* — Marcus Harcum
(74) *Attorney, Agent, or Firm* — Tamika A. Crawl-Bey

(57) ABSTRACT

Connectors and methods for attaching connectors to one or more cables and/or conduits are disclosed. The disclosed connectors and methods may secure an outer surface of the cable (e.g., an outer jacket of a cable) or conduit. A connector, for example, may include a coupler comprising an inner surface defining an coupler inner bore; a retainer comprising an inner surface defining a retainer inner bore configured to receive the inner conductor and insulator layer of a coaxial cable and an outer angled rear facing surface configured to extend between the insulator layer and the outer conductor layer of the coaxial cable, the retainer disposed within the inner bore of the coupler; a hub engaged to the retainer and disposed at least partially within the inner bore of the coupler, the hub rotatably engaged with the coupler, the hub further comprising an outer angled forward facing surface at least partially opposing the outer angled rear facing surface of the retainer, wherein the outer angled rear facing surface of the retainer and the outer angled forward facing surface of the hub are configured to secure the outer conductor layer between the outer angled rear facing surface of the retainer and the outer angled forward facing surface of the hub.

21 Claims, 13 Drawing Sheets

(58) Field of Classification Search
USPC ..... 439/584, 585, 578
See application file for complete search history.

(56) References Cited

U.S. PATENT DOCUMENTS

| | | | |
|---|---|---|---|
| 459,951 | A | 9/1891 | Warner |
| 589,216 | A | 8/1897 | McKee |
| 1,371,742 | A | 3/1921 | Dringman |
| 1,488,175 | A | 3/1924 | Strandell |
| 1,667,485 | A | 4/1928 | MacDonald |
| 1,766,869 | A | 6/1930 | Austin |
| 1,801,999 | A | 4/1931 | Bowman |
| 1,885,761 | A | 11/1932 | Peirce, Jr. |
| 1,959,302 | A | 5/1934 | Paige |
| 2,013,526 | A | 9/1935 | Schmitt |
| 2,059,920 | A | 11/1936 | Weatherhead, Jr. |
| 2,102,495 | A | 12/1937 | England |
| 2,258,528 | A | 10/1941 | Wurzburger |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,705,652 | A | 4/1955 | Kaiser |
| 2,743,505 | A | 5/1956 | Hill |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,785,384 | A | 3/1957 | Wickesser |
| 2,805,399 | A | 9/1957 | Leeper |
| 2,816,949 | A | 12/1957 | Curtiss |
| 2,870,420 | A | 1/1959 | Malek |
| 2,878,039 | A | 3/1959 | Hoegee et al. |
| 2,881,406 | A | 4/1959 | Arson |
| 2,963,536 | A | 12/1960 | Kokalas |
| 3,001,169 | A | 9/1961 | Blonder |
| 3,015,794 | A | 1/1962 | Kishbaugh |
| 3,051,925 | A | 8/1962 | Felts |
| 3,091,748 | A | 5/1963 | Takes et al. |
| 3,094,364 | A | 6/1963 | Lingg |
| 3,103,548 | A | 9/1963 | Concelman |
| 3,106,548 | A | 10/1963 | Lavalou |
| 3,140,106 | A | 7/1964 | Thomas et al. |
| 3,161,451 | A | 12/1964 | Neidecker |
| 3,184,706 | A | 5/1965 | Atkins |
| 3,193,309 | A | 7/1965 | Morris |
| 3,194,292 | A | 7/1965 | Borowsky |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,756 | A | 10/1966 | O'Keefe et al. |
| 3,281,757 | A | 10/1966 | Bonhomme |
| 3,290,069 | A | 12/1966 | Davis |
| 3,292,136 | A | 12/1966 | Somerset |
| 3,320,575 | A | 5/1967 | Brown et al. |
| 3,321,732 | A | 5/1967 | Forney, Jr. |
| 3,336,563 | A | 8/1967 | Hyslop |
| 3,348,186 | A | 10/1967 | Rosen |
| 3,350,667 | A | 10/1967 | Shreve |
| 3,350,677 | A | 10/1967 | Daum |
| 3,355,698 | A | 11/1967 | Keller |
| 3,372,364 | A | 3/1968 | O'Keefe et al. |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,430,184 | A | 2/1969 | Acord |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,494,400 | A | 2/1970 | McCoy et al. |
| 3,498,647 | A | 3/1970 | Schroder |
| 3,499,671 | A | 3/1970 | Osborne |
| 3,501,737 | A | 3/1970 | Harris et al. |
| 3,517,373 | A | 6/1970 | Jamon |
| 3,526,871 | A | 9/1970 | Hobart |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,596,933 | A | 8/1971 | Luckenbill |
| 3,601,776 | A | 8/1971 | Curl |
| 3,603,912 | A | 9/1971 | Kelly |
| 3,614,711 | A | 10/1971 | Anderson et al. |
| 3,622,952 | A | 11/1971 | Hilbert |
| 3,629,792 | A | 12/1971 | Dorrell |
| 3,633,150 | A | 1/1972 | Schwartz |
| 3,646,502 | A | 2/1972 | Hutter et al. |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,671,926 | A | 6/1972 | Nepovim |
| 3,678,444 | A | 7/1972 | Stevens et al. |
| 3,678,445 | A | 7/1972 | Brancaloene |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,694,793 | A | 9/1972 | Concelman |
| 3,697,930 | A | 10/1972 | Shirey |
| 3,706,958 | A | 12/1972 | Blanchenot |
| 3,708,186 | A | 1/1973 | Takagi et al. |
| 3,710,005 | A | 1/1973 | French |
| 3,739,076 | A | 6/1973 | Schwartz |
| 3,744,007 | A | 7/1973 | Horak |
| 3,744,011 | A | 7/1973 | Blanchenot |
| 3,761,870 | A | 9/1973 | Drezin et al. |
| 3,778,535 | A | 12/1973 | Forney, Jr. |
| 3,781,762 | A | 12/1973 | Quackenbush |
| 3,781,898 | A | 12/1973 | Holloway |
| 3,783,178 | A | 1/1974 | Philibert et al. |
| 3,787,796 | A | 1/1974 | Barr |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,824,026 | A | 7/1974 | Gaskins |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,847,463 | A | 11/1974 | Hayward et al. |
| 3,854,003 | A | 12/1974 | Duret |
| 3,854,789 | A | 12/1974 | Kaplan |
| 3,858,156 | A | 12/1974 | Zarro |
| 3,879,102 | A | 4/1975 | Horak |
| 3,886,301 | A | 5/1975 | Cronin et al. |
| 3,907,335 | A | 9/1975 | Burge et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,937,547 | A | 2/1976 | Lee-Kemp |
| 3,953,097 | A | 4/1976 | Graham |
| 3,960,428 | A | 6/1976 | Naus et al. |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 3,986,736 | A | 10/1976 | Takagi et al. |
| 4,012,105 | A | 3/1977 | Biddle |
| 4,017,139 | A | 4/1977 | Nelson |

(56) References Cited

U.S. PATENT DOCUMENTS 4,022,966 A 5/1977 Gajajiva
4,030,742 A 6/1977 Eidelberg et al.
4,030,798 A 6/1977 Paoli
4,032,177 A 6/1977 Anderson
4,045,706 A 8/1977 Daffner et al.
4,046,451 A 9/1977 Juds et al.
4,053,200 A 10/1977 Pugner
4,056,043 A 11/1977 Sriramamurty et al.
4,059,330 A 11/1977 Shirey
4,079,343 A 3/1978 Nijman
4,082,404 A 4/1978 Flatt
4,090,028 A 5/1978 Vontobel
4,093,335 A 6/1978 Schwartz et al.
4,100,943 A 7/1978 Terada et al.
4,106,839 A 8/1978 Cooper
4,109,126 A 8/1978 Halbeck
4,118,097 A 10/1978 Budnick
4,125,308 A 11/1978 Schilling
4,126,372 A 11/1978 Hashimoto et al.
4,131,332 A 12/1978 Hogendobler et al.
4,136,897 A 1/1979 Haluch
4,150,250 A 4/1979 Lundeberg
4,153,320 A 5/1979 Townshend
4,156,554 A 5/1979 Aujla
4,165,911 A 8/1979 Laudig
4,168,921 A 9/1979 Blanchard
4,169,646 A 10/1979 Stape et al.
4,173,385 A 11/1979 Fenn et al.
4,174,875 A 11/1979 Wilson et al.
4,187,481 A 2/1980 Bourtos
4,193,655 A 3/1980 Herrmann, Jr.
4,194,338 A 3/1980 Trafton
4,197,628 A 4/1980 Conti et al.
4,206,963 A 6/1980 English et al.
4,212,487 A 7/1980 Jones et al.
4,225,162 A 9/1980 Dola
4,227,765 A 10/1980 Neumann et al.
4,229,714 A 10/1980 Yu
4,239,318 A 12/1980 Schwartz
4,250,348 A 2/1981 Kitagawa
4,260,212 A 4/1981 Ritchie
4,273,405 A 6/1981 Law
4,280,749 A 7/1981 Hemmer
4,285,564 A 8/1981 Spinner
4,290,663 A 9/1981 Fowler et al.
4,296,986 A 10/1981 Herrmann, Jr.
4,307,926 A 12/1981 Smith
4,309,050 A 1/1982 Legris
4,310,211 A 1/1982 Bunnell et al.
4,322,121 A 3/1982 Riches et al.
4,326,768 A 4/1982 Punako
4,326,769 A 4/1982 Dorsey et al.
4,334,730 A 6/1982 Colwell et al.
4,339,166 A 7/1982 Dayton
4,345,375 A 8/1982 Hayward
4,346,958 A 8/1982 Blanchard
4,354,721 A 10/1982 Luzzi
4,358,174 A 11/1982 Dreyer
4,373,767 A 2/1983 Cairns
4,389,081 A 6/1983 Gallusser et al.
4,400,050 A 8/1983 Hayward
4,407,529 A 10/1983 Holman
4,408,821 A 10/1983 Forney, Jr.
4,408,822 A 10/1983 Nikitas
4,412,717 A 11/1983 Monroe
4,421,377 A 12/1983 Spinner
4,426,127 A 1/1984 Kubota
4,428,639 A 1/1984 Hillis
4,444,453 A 4/1984 Kirby et al.
4,447,107 A 5/1984 Major et al.
4,452,503 A 6/1984 Forney, Jr.
4,453,200 A 6/1984 Trcka et al.
4,456,323 A 6/1984 Pitcher et al.
4,459,881 A 7/1984 Hughes, Jr.
4,462,653 A 7/1984 Flederbach et al.
4,464,000 A 8/1984 Werth et al.
4,464,001 A 8/1984 Collins
4,469,386 A 9/1984 Ackerman
4,470,657 A 9/1984 Deacon
4,477,132 A 10/1984 Moser et al.
4,484,792 A 11/1984 Tengler et al.
4,484,796 A 11/1984 Sato et al.
4,490,576 A 12/1984 Bolante et al.
4,491,685 A 1/1985 Drew et al.
4,506,943 A 3/1985 Drogo
4,515,427 A 5/1985 Smit
4,525,017 A 6/1985 Schildkraut et al.
4,531,790 A 7/1985 Selvin
4,531,805 A 7/1985 Werth
4,533,191 A 8/1985 Blackwood
4,540,231 A 9/1985 Forney, Jr.
RE31,995 E 10/1985 Ball
4,545,633 A 10/1985 McGeary
4,545,637 A 10/1985 Bosshard et al.
4,553,877 A 11/1985 Edvardsen
4,575,274 A 3/1986 Hayward
4,580,862 A 4/1986 Johnson
4,580,865 A 4/1986 Fryberger
4,583,811 A 4/1986 McMills
4,585,289 A 4/1986 Bocher
4,588,246 A 5/1986 Schildkraut et al.
4,593,964 A 6/1986 Forney, Jr. et al.
4,596,434 A 6/1986 Saba et al.
4,596,435 A 6/1986 Bickford
4,597,621 A 7/1986 Burns
4,598,959 A 7/1986 Selvin
4,598,961 A 7/1986 Cohen
4,600,263 A 7/1986 DeChamp et al.
4,613,199 A 9/1986 McGeary
4,614,390 A 9/1986 Baker
4,616,900 A 10/1986 Cairns
4,623,205 A 11/1986 Barron
4,632,487 A 12/1986 Wargula
4,634,213 A 1/1987 Larsson et al.
4,640,572 A 2/1987 Conlon
4,645,281 A 2/1987 Burger
4,647,135 A 3/1987 Reinhardt
4,650,228 A 3/1987 McMills et al.
4,655,159 A 4/1987 McMills
4,655,534 A 4/1987 Stursa
4,660,921 A 4/1987 Hauver
4,666,190 A 5/1987 Yamabe et al.
4,666,231 A 5/1987 Sheesley et al.
4,668,043 A 5/1987 Saba et al.
4,670,574 A 6/1987 Malcolm
4,673,236 A 6/1987 Musolff et al.
4,674,809 A 6/1987 Hollyday et al.
4,674,818 A 6/1987 McMills et al.
4,676,577 A 6/1987 Szegda
4,682,832 A 7/1987 Punako et al.
4,684,201 A 8/1987 Hutter
4,688,876 A 8/1987 Morelli
4,688,878 A 8/1987 Cohen et al.
4,690,482 A 9/1987 Chamberland et al.
4,691,976 A 9/1987 Cowen
4,703,987 A 11/1987 Gullusser et al.
4,703,988 A 11/1987 Raux et al.
4,713,021 A 12/1987 Kobler
4,717,355 A 1/1988 Mattis
4,720,155 A 1/1988 Schildkraut et al.
4,728,301 A 3/1988 Hemmer et al.
4,734,050 A 3/1988 Negre et al.
4,734,666 A 3/1988 Ohya et al.
4,737,123 A 4/1988 Paler et al.
4,738,009 A 4/1988 Down et al.
4,738,628 A 4/1988 Rees
4,739,009 A 4/1988 Down et al.
4,739,126 A 4/1988 Gutter et al.
4,746,305 A 5/1988 Nomura
4,747,656 A 5/1988 Miyahara et al.
4,747,786 A 5/1988 Hayashi et al.
4,749,821 A 6/1988 Linton et al.
4,755,152 A 7/1988 Elliot et al.
4,757,274 A 7/1988 Bowers

(56) References Cited

U.S. PATENT DOCUMENTS 4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,789,759 A 12/1988 Jones
4,795,360 A 1/1989 Newman et al.
4,797,120 A 1/1989 Ulery
4,806,116 A 2/1989 Ackerman
4,807,891 A 2/1989 Neher
4,808,128 A 2/1989 Werth
4,810,017 A 3/1989 Knak et al.
4,813,886 A 3/1989 Roos et al.
4,820,185 A 4/1989 Moulin
4,834,675 A 5/1989 Samchisen
4,834,676 A 5/1989 Tackett
4,835,342 A 5/1989 Guginsky
4,836,580 A 6/1989 Farrell
4,836,801 A 6/1989 Ramirez
4,838,813 A 6/1989 Pauza et al.
4,846,731 A 7/1989 Alwine
4,854,893 A 8/1989 Morris
4,857,014 A 8/1989 Alf et al.
4,867,489 A 9/1989 Patel
4,867,706 A 9/1989 Tang
4,869,679 A 9/1989 Szegda
4,874,331 A 10/1989 Iverson
4,881,912 A 11/1989 Thommen et al.
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,934,960 A 6/1990 Capp et al.
4,938,718 A 7/1990 Guendel
4,941,846 A 7/1990 Guimond et al.
4,952,174 A 8/1990 Sucht et al.
4,957,456 A 9/1990 Olson et al.
4,963,105 A 10/1990 Lewis et al.
4,964,805 A 10/1990 Gabany
4,964,812 A 10/1990 Siemon et al.
4,973,265 A 11/1990 Heeren
4,976,632 A 12/1990 Riches
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,422 A 4/1991 Yeh
5,011,432 A 4/1991 Sucht et al.
5,018,822 A 5/1991 Freismuth et al.
5,021,010 A 6/1991 Wright
5,024,606 A 6/1991 Ming-Hwa
5,030,126 A 7/1991 Hanlon
5,037,328 A 8/1991 Karlovich
5,046,964 A 9/1991 Welsh et al.
5,052,947 A 10/1991 Brodie et al.
5,055,060 A 10/1991 Down et al.
5,059,139 A 10/1991 Spinner
5,059,747 A 10/1991 Bawa et al.
5,062,804 A 11/1991 Jamet et al.
5,066,248 A 11/1991 Gaver, Jr. et al.
5,067,912 A 11/1991 Bickford et al.
5,073,129 A 12/1991 Szegda
5,074,809 A 12/1991 Rousseau
5,080,600 A 1/1992 Baker et al.
5,083,943 A 1/1992 Tarrant
5,088,937 A 2/1992 Gabany
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,139,440 A 8/1992 Volk et al.
5,141,448 A 8/1992 Mattingly et al.
5,141,451 A 8/1992 Down
5,149,274 A 9/1992 Gallusser et al.
5,150,924 A 9/1992 Yokomatsu et al.
5,154,636 A 10/1992 Vaccaro et al.
5,161,993 A 11/1992 Leibfried, Jr.
5,166,477 A 11/1992 Perin, Jr. et al.
5,167,545 A 12/1992 O'Brien et al.
5,169,323 A 12/1992 Kawai et al.
5,176,530 A 1/1993 Reylek
5,176,533 A 1/1993 Sakurai et al.
5,181,161 A 1/1993 Hirose et al.
5,183,417 A 2/1993 Bools
5,185,655 A 2/1993 Glenday et al.
5,186,501 A 2/1993 Mano
5,186,655 A 2/1993 Glenday et al.
5,195,904 A 3/1993 Cyvoct
5,195,905 A 3/1993 Pesci
5,195,906 A 3/1993 Szegda
5,205,547 A 4/1993 Mattingly
5,205,761 A 4/1993 Nilsson
D335,487 S 5/1993 Volk et al.
5,207,602 A 5/1993 McMills et al.
5,215,477 A 6/1993 Weber et al.
5,217,391 A 6/1993 Fisher, Jr.
5,217,392 A 6/1993 Hosler, Sr.
5,217,393 A 6/1993 Del Negro et al.
5,221,216 A 6/1993 Gabany et al.
5,227,587 A 7/1993 Paterek
5,247,424 A 9/1993 Harris et al.
5,263,880 A 11/1993 Schwarz et al.
5,269,701 A 12/1993 Leibfried, Jr.
5,281,762 A 1/1994 Long et al.
5,283,417 A 2/1994 Misawa et al.
5,283,853 A 2/1994 Szegda
5,284,449 A 2/1994 Vaccaro
5,294,864 A 3/1994 Do
5,295,864 A 3/1994 Birch et al.
5,316,348 A 5/1994 Franklin
5,316,494 A 5/1994 Flanagan et al.
5,318,459 A 6/1994 Sheilds
5,321,205 A 6/1994 Bawa et al.
5,334,032 A 8/1994 Myers et al.
5,334,051 A 8/1994 Devine et al.
5,338,225 A 8/1994 Jacobsen et al.
5,342,218 A 8/1994 McMills et al.
5,352,134 A 10/1994 Jacobsen et al.
5,354,217 A 10/1994 Gabel et al.
5,362,250 A 11/1994 McMills et al.
5,362,251 A 11/1994 Bielak
5,366,260 A 11/1994 Wartluft
5,371,819 A 12/1994 Szegda
5,371,821 A 12/1994 Szegda
5,371,827 A 12/1994 Szegda
5,380,211 A 1/1995 Kawagauchi et al.
5,389,005 A 2/1995 Kodama
5,393,244 A 2/1995 Szegda
5,397,252 A 3/1995 Wang
5,413,504 A 5/1995 Kloecker et al.
5,431,583 A 7/1995 Szegda
5,435,745 A 7/1995 Booth
5,435,751 A 7/1995 Papenheim et al.
5,435,760 A 7/1995 Miklos
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,475,921 A 12/1995 Johnston
5,488,268 A 1/1996 Bauer et al.
5,490,033 A 2/1996 Cronin

(56) References Cited

U.S. PATENT DOCUMENTS

| | | | |
|---|---|---|---|
| 5,490,801 | A | 2/1996 | Fisher, Jr. et al. |
| 5,494,454 | A | 2/1996 | Johnsen |
| 5,499,934 | A | 3/1996 | Jacobsen et al. |
| 5,501,616 | A | 3/1996 | Holliday |
| 5,511,305 | A | 4/1996 | Garner |
| 5,516,303 | A | 5/1996 | Yohn et al. |
| 5,525,076 | A | 6/1996 | Down |
| 5,542,861 | A | 8/1996 | Anhalt et al. |
| 5,548,088 | A | 8/1996 | Gray et al. |
| 5,550,521 | A | 8/1996 | Bernaud et al. |
| 5,564,938 | A | 10/1996 | Shenkal et al. |
| 5,566,173 | A | 10/1996 | Steinbrecher |
| 5,571,028 | A | 11/1996 | Szegda |
| 5,571,029 | A | 11/1996 | Poissant et al. |
| 5,586,910 | A | 12/1996 | Del Negro et al. |
| 5,595,499 | A | 1/1997 | Zander et al. |
| 5,598,132 | A | 1/1997 | Stabile |
| 5,607,320 | A | 3/1997 | Wright |
| 5,607,325 | A | 3/1997 | Toma |
| 5,609,501 | A | 3/1997 | McMills et al. |
| 5,620,339 | A | 4/1997 | Gray et al. |
| 5,632,637 | A | 5/1997 | Diener |
| 5,632,651 | A | 5/1997 | Szegda |
| 5,644,104 | A | 7/1997 | Porter et al. |
| 5,649,723 | A | 7/1997 | Larsson |
| 5,651,698 | A | 7/1997 | Locati et al. |
| 5,651,699 | A | 7/1997 | Holliday |
| 5,653,605 | A | 8/1997 | Woehl et al. |
| 5,667,405 | A | 9/1997 | Holliday |
| 5,681,172 | A | 10/1997 | Moldenhauer |
| 5,683,263 | A | 11/1997 | Hsu |
| 5,702,263 | A | 12/1997 | Baumann et al. |
| 5,722,856 | A | 3/1998 | Fuchs et al. |
| 5,735,704 | A | 4/1998 | Anthony |
| 5,743,131 | A | 4/1998 | Holliday et al. |
| 5,746,617 | A | 5/1998 | Porter, Jr. et al. |
| 5,746,619 | A | 5/1998 | Harting et al. |
| 5,759,618 | A | 6/1998 | Taylor |
| 5,761,053 | A | 6/1998 | King et al. |
| 5,769,622 | A | 6/1998 | Stabile et al. |
| 5,769,652 | A | 6/1998 | Wider |
| 5,769,662 | A | 6/1998 | Stabile et al. |
| 5,774,344 | A | 6/1998 | Casebolt |
| 5,775,927 | A | 7/1998 | Wider |
| 5,788,289 | A | 8/1998 | Cronley |
| 5,791,698 | A | 8/1998 | Wartluft et al. |
| 5,797,633 | A | 8/1998 | Katzer et al. |
| 5,817,978 | A | 10/1998 | Hermant et al. |
| 5,863,220 | A | 1/1999 | Holliday |
| 5,874,603 | A | 2/1999 | Arkles |
| 5,877,452 | A | 3/1999 | McConnell |
| 5,879,191 | A | 3/1999 | Burris |
| 5,882,226 | A | 3/1999 | Bell et al. |
| 5,890,924 | A | 4/1999 | Endo |
| 5,897,795 | A | 4/1999 | Lu et al. |
| 5,906,511 | A | 5/1999 | Bozzer et al. |
| 5,917,153 | A | 6/1999 | Geroldinger |
| 5,921,793 | A | 7/1999 | Phillips |
| 5,929,383 | A | 7/1999 | Marik et al. |
| 5,938,465 | A | 8/1999 | Fox, Sr. |
| 5,939,465 | A | 8/1999 | Fox, Sr. |
| 5,944,548 | A | 8/1999 | Saito |
| 5,951,327 | A | 9/1999 | Marik |
| 5,954,708 | A | 9/1999 | Lopez et al. |
| 5,957,716 | A | 9/1999 | Buckley et al. |
| 5,967,852 | A | 10/1999 | Follingstad et al. |
| 5,975,479 | A | 11/1999 | Suter |
| 5,975,591 | A | 11/1999 | Guest |
| 5,975,949 | A | 11/1999 | Holliday et al. |
| 5,975,951 | A | 11/1999 | Burris et al. |
| 5,977,841 | A | 11/1999 | Lee et al. |
| 5,997,350 | A | 12/1999 | Burris et al. |
| 6,010,349 | A | 1/2000 | Porter, Jr. |
| 6,019,635 | A | 2/2000 | Nelson |
| 6,022,237 | A | 2/2000 | Esh |
| 6,032,358 | A | 3/2000 | Wild |
| 6,036,540 | A | 3/2000 | Beloritsky |
| 6,042,422 | A | 3/2000 | Youtsey |
| 6,042,429 | A | 3/2000 | Bianca et al. |
| 6,048,229 | A | 4/2000 | Lazaro, Jr. |
| 6,053,743 | A | 4/2000 | Mitchell et al. |
| 6,053,769 | A | 4/2000 | Kubota et al. |
| 6,053,777 | A | 4/2000 | Boyle |
| 6,062,607 | A | 5/2000 | Barthlomew |
| 6,080,015 | A | 6/2000 | Andreescu |
| 6,083,030 | A | 7/2000 | Wright |
| 6,083,053 | A | 7/2000 | Anderson, Jr. et al. |
| 6,089,903 | A | 7/2000 | Stafford Gray et al. |
| 6,089,912 | A | 7/2000 | Tallis et al. |
| 6,089,913 | A | 7/2000 | Holliday |
| 6,093,043 | A | 7/2000 | Gray et al. |
| 6,095,828 | A | 8/2000 | Burland |
| 6,095,841 | A | 8/2000 | Felps |
| 6,123,550 | A | 9/2000 | Burkert et al. |
| 6,123,567 | A | 9/2000 | McCarthy |
| 6,126,487 | A | 10/2000 | Rosenberger |
| 6,132,234 | A | 10/2000 | Waidner et al. |
| 6,142,812 | A | 11/2000 | Hwang |
| 6,146,197 | A | 11/2000 | Holliday et al. |
| 6,152,752 | A | 11/2000 | Fukuda |
| 6,152,753 | A | 11/2000 | Johnson et al. |
| 6,153,830 | A | 11/2000 | Montena |
| 6,158,298 | A | 12/2000 | Hara |
| 6,162,995 | A | 12/2000 | Bachle et al. |
| 6,164,977 | A | 12/2000 | Lester |
| 6,174,206 | B1 | 1/2001 | Yentile et al. |
| 6,183,298 | B1 | 2/2001 | Henningsen |
| 6,199,913 | B1 | 3/2001 | Wang |
| 6,199,920 | B1 | 3/2001 | Neustadtl |
| 6,210,216 | B1 | 4/2001 | Tso-Chin et al. |
| 6,210,219 | B1 | 4/2001 | Zhu et al. |
| 6,210,222 | B1 | 4/2001 | Langham et al. |
| 6,217,383 | B1 | 4/2001 | Holland et al. |
| 6,238,240 | B1 | 5/2001 | Yu |
| 6,239,359 | B1 | 5/2001 | Lilienthal, II et al. |
| 6,241,553 | B1 | 6/2001 | Hsia |
| 6,250,942 | B1 | 6/2001 | Lemke et al. |
| 6,250,974 | B1 | 6/2001 | Kerek |
| 6,257,923 | B1 | 7/2001 | Stone et al. |
| 6,261,126 | B1 | 7/2001 | Stirling |
| 6,267,612 | B1 | 7/2001 | Areykiewicz et al. |
| 6,271,464 | B1 | 8/2001 | Cunningham |
| 6,299,475 | B1 | 10/2001 | Huspeni et al. |
| 6,331,123 | B1 | 12/2001 | Rodrigues |
| 6,332,815 | B1 | 12/2001 | Bruce |
| 6,352,448 | B1 | 3/2002 | Holliday et al. |
| 6,358,077 | B1 | 3/2002 | Young |
| 6,361,348 | B1 | 3/2002 | Hall et al. |
| 6,361,364 | B1 | 3/2002 | Holland et al. |
| 6,375,509 | B2 | 4/2002 | Mountford |
| 6,379,183 | B1 | 4/2002 | Ayres et al. |
| 6,394,840 | B1 | 5/2002 | Gassauer et al. |
| 6,396,367 | B1 | 5/2002 | Rosenberger |
| D458,904 | S | 6/2002 | Montena |
| 6,398,571 | B1 | 6/2002 | Nishide et al. |
| 6,406,330 | B2 | 6/2002 | Bruce |
| 6,409,534 | B1 | 6/2002 | Weisz-Margulescu |
| D460,739 | S | 7/2002 | Fox |
| D460,740 | S | 7/2002 | Montena |
| D460,946 | S | 7/2002 | Montena |
| D460,947 | S | 7/2002 | Montena |
| D460,948 | S | 7/2002 | Montena |
| 6,422,884 | B1 | 7/2002 | Babasick et al. |
| 6,422,900 | B1 | 7/2002 | Hogan |
| 6,425,782 | B1 | 7/2002 | Holland |
| D461,166 | S | 8/2002 | Montena |
| D461,167 | S | 8/2002 | Montena |
| D461,778 | S | 8/2002 | Fox |
| D462,058 | S | 8/2002 | Montena |
| D462,060 | S | 8/2002 | Fox |
| 6,439,899 | B1 | 8/2002 | Muzslay et al. |
| D462,327 | S | 9/2002 | Montena |
| 6,443,763 | B1 | 9/2002 | Richet |
| 6,450,829 | B1 | 9/2002 | Weisz-Margulescu |

(56) References Cited

U.S. PATENT DOCUMENTS

| | | | |
|---|---|---|---|
| 6,454,463 | B1 | 9/2002 | Halbach |
| 6,464,526 | B1 | 10/2002 | Seufert et al. |
| 6,464,527 | B2 | 10/2002 | Volpe et al. |
| 6,467,816 | B1 | 10/2002 | Huang |
| 6,468,100 | B1 | 10/2002 | Meyer et al. |
| 6,468,103 | B1 | 10/2002 | Brower |
| 6,491,546 | B1 | 12/2002 | Perry |
| D468,696 | S | 1/2003 | Montena |
| 6,506,083 | B1 | 1/2003 | Bickford et al. |
| 6,510,610 | B2 | 1/2003 | Losinger |
| 6,520,800 | B1 | 2/2003 | Michelbach et al. |
| 6,530,807 | B2 | 3/2003 | Rodrigues et al. |
| 6,540,531 | B2 | 4/2003 | Syed et al. |
| 6,558,194 | B2 | 5/2003 | Montena |
| 6,572,419 | B2 | 6/2003 | Feye-Homann |
| 6,576,833 | B2 | 6/2003 | Covaro et al. |
| 6,619,876 | B2 | 9/2003 | Vaitkus et al. |
| 6,632,104 | B2 | 10/2003 | Quadir |
| 6,634,906 | B1 | 10/2003 | Yeh |
| 6,637,101 | B2 | 10/2003 | Hathaway et al. |
| 6,645,011 | B2 | 11/2003 | Schneider et al. |
| 6,663,397 | B1 | 12/2003 | Lin et al. |
| 6,676,446 | B2 | 1/2004 | Montena |
| 6,683,253 | B1 | 1/2004 | Lee |
| 6,683,773 | B2 | 1/2004 | Montena |
| 6,692,285 | B2 | 2/2004 | Islam |
| 6,692,286 | B1 | 2/2004 | De Cet |
| 6,695,636 | B2 | 2/2004 | Hall et al. |
| 6,705,875 | B2 | 3/2004 | Berghorn et al. |
| 6,705,884 | B1 | 3/2004 | McCarthy |
| 6,709,280 | B1 | 3/2004 | Gretz |
| 6,709,289 | B2 | 3/2004 | Huber et al. |
| 6,712,631 | B1 | 3/2004 | Youtsey |
| 6,716,041 | B2 | 4/2004 | Ferderer et al. |
| 6,716,062 | B1 | 4/2004 | Palinkas et al. |
| 6,733,336 | B1 | 5/2004 | Montena et al. |
| 6,733,337 | B2 | 5/2004 | Kodaira |
| 6,743,040 | B1 | 6/2004 | Nakamura |
| 6,749,454 | B2 | 6/2004 | Schmidt et al. |
| 6,751,081 | B1 | 6/2004 | Kooiman |
| 6,752,633 | B2 | 6/2004 | Aizawa et al. |
| 6,761,571 | B2 | 7/2004 | Hida |
| 6,767,248 | B1 | 7/2004 | Hung |
| 6,769,926 | B1 | 8/2004 | Montena |
| 6,780,029 | B1 | 8/2004 | Gretz |
| 6,780,042 | B1 | 8/2004 | Badescu et al. |
| 6,780,052 | B2 | 8/2004 | Montena et al. |
| 6,780,068 | B2 | 8/2004 | Bartholoma et al. |
| 6,783,394 | B1 | 8/2004 | Holliday |
| 6,690,081 | B2 | 9/2004 | Burris et al. |
| 6,786,767 | B1 | 9/2004 | Fuks et al. |
| 6,790,081 | B2 | 9/2004 | Burris et al. |
| 6,793,528 | B2 | 9/2004 | Lin et al. |
| 6,796,847 | B2 | 9/2004 | AbuGhezaleh |
| 6,802,738 | B1 | 10/2004 | Henningsen |
| 6,805,581 | B2 | 10/2004 | Chen |
| 6,805,583 | B2 | 10/2004 | Holliday et al. |
| 6,805,584 | B1 | 10/2004 | Chen |
| 6,808,415 | B1 | 10/2004 | Montena |
| 6,817,272 | B2 | 11/2004 | Holland |
| 6,817,896 | B2 | 11/2004 | Derenthal |
| 6,817,897 | B2 | 11/2004 | Chee |
| 6,827,608 | B2 | 12/2004 | Hall et al. |
| 6,830,479 | B2 | 12/2004 | Holliday |
| 6,848,115 | B2 | 1/2005 | Sugiura et al. |
| 6,848,939 | B2 | 2/2005 | Stirling |
| 6,848,940 | B2 | 2/2005 | Montena |
| 6,848,941 | B2 | 2/2005 | Wlos et al. |
| 6,884,113 | B1 | 4/2005 | Montena |
| 6,884,115 | B2 | 4/2005 | Malloy |
| 6,887,102 | B1 | 5/2005 | Burris et al. |
| 6,916,200 | B2 | 7/2005 | Burris et al. |
| 6,929,265 | B2 | 8/2005 | Holland et al. |
| 6,929,508 | B1 | 8/2005 | Holland |
| 6,935,866 | B2 | 8/2005 | Kerekes et al. |
| 6,939,169 | B2 | 9/2005 | Islam et al. |
| 6,942,516 | B2 | 9/2005 | Shimoyama et al. |
| 6,942,520 | B2 | 9/2005 | Barlian et al. |
| 6,944,005 | B2 | 9/2005 | Kooiman |
| 6,945,805 | B1 | 9/2005 | Bollinger |
| 6,948,976 | B2 | 9/2005 | Goodwin et al. |
| 6,953,371 | B2 | 10/2005 | Baker et al. |
| 6,955,563 | B1 | 10/2005 | Croan |
| D511,497 | S | 11/2005 | Murphy et al. |
| D512,024 | S | 11/2005 | Murphy et al. |
| D512,689 | S | 12/2005 | Murphy et al. |
| 6,971,912 | B2 | 12/2005 | Montena et al. |
| 6,979,234 | B2 | 12/2005 | Bleicher |
| 7,008,263 | B2 | 3/2006 | Holland |
| 7,018,216 | B1 | 3/2006 | Clark et al. |
| 7,018,235 | B1 | 3/2006 | Burris et al. |
| 7,029,326 | B2 | 4/2006 | Montena |
| D521,454 | S | 5/2006 | Murphy et al. |
| 7,062,851 | B2 | 6/2006 | Koessler |
| 7,063,565 | B2 | 6/2006 | Ward |
| 7,070,447 | B1 | 7/2006 | Montena |
| 7,077,697 | B2 | 7/2006 | Kooiman |
| 7,077,699 | B2 | 7/2006 | Islam et al. |
| 7,086,897 | B2 | 8/2006 | Montena |
| 7,090,525 | B1 | 8/2006 | Morana |
| 7,094,114 | B2 | 8/2006 | Kurimoto |
| 7,097,499 | B1 | 8/2006 | Purdy |
| 7,102,868 | B2 | 9/2006 | Montena |
| 7,108,547 | B2 | 9/2006 | Kisling et al. |
| 7,108,548 | B2 | 9/2006 | Burris et al. |
| 7,112,078 | B2 | 9/2006 | Czikora |
| 7,112,093 | B1 | 9/2006 | Holland |
| 7,114,990 | B2 | 10/2006 | Bence et al. |
| 7,118,285 | B2 | 10/2006 | Fenwick et al. |
| 7,118,382 | B2 | 10/2006 | Kerekes et al. |
| 7,118,416 | B2 | 10/2006 | Montena et al. |
| 7,125,283 | B1 | 10/2006 | Lin |
| 7,128,603 | B2 | 10/2006 | Burris et al. |
| 7,128,604 | B2 | 10/2006 | Hall |
| 7,131,867 | B1 | 11/2006 | Foster et al. |
| 7,131,868 | B2 | 11/2006 | Montena |
| 7,140,645 | B2 | 11/2006 | Cronley |
| 7,144,271 | B1 | 12/2006 | Burris et al. |
| 7,144,272 | B1 | 12/2006 | Burris et al. |
| 7,147,509 | B1 | 12/2006 | Burris et al. |
| 7,153,159 | B2 | 12/2006 | Burris et al. |
| 7,156,696 | B1 | 1/2007 | Montena |
| 7,161,785 | B2 | 1/2007 | Chawgo |
| 7,165,974 | B2 | 1/2007 | Kooiman |
| 7,168,992 | B2 | 1/2007 | Vo et al. |
| 7,173,121 | B2 | 2/2007 | Fang |
| 7,179,121 | B1 | 2/2007 | Burris et al. |
| 7,179,122 | B2 | 2/2007 | Holliday |
| 7,182,639 | B2 | 2/2007 | Burris |
| 7,183,639 | B2 | 2/2007 | Mihara et al. |
| 7,189,097 | B2 | 3/2007 | Benham |
| 7,189,114 | B1 | 3/2007 | Burris et al. |
| 7,192,308 | B2 | 3/2007 | Rodrigues et al. |
| 7,229,303 | B2 | 6/2007 | Vermoesen et al. |
| 7,238,047 | B2 | 7/2007 | Saetele et al. |
| 7,252,536 | B2 | 8/2007 | Lazaro, Jr. et al. |
| 7,252,546 | B1 | 8/2007 | Holland |
| 7,255,598 | B2 | 8/2007 | Montena et al. |
| 7,261,594 | B2 | 8/2007 | Kodama et al. |
| 7,264,502 | B2 | 9/2007 | Holland |
| 7,278,882 | B1 | 10/2007 | Li |
| 7,288,002 | B2 | 10/2007 | Rodrigues et al. |
| 7,229,550 | B2 | 11/2007 | Montena |
| 7,291,033 | B2 | 11/2007 | Hu |
| 7,297,023 | B2 | 11/2007 | Chawgo |
| 7,299,550 | B2 | 11/2007 | Montena |
| 7,303,435 | B2 | 12/2007 | Burris et al. |
| 7,311,555 | B1 | 12/2007 | Burris et al. |
| 7,318,609 | B2 | 1/2008 | Naito et al. |
| 7,322,846 | B2 | 1/2008 | Camelio |
| 7,322,851 | B2 | 1/2008 | Brookmire |
| 7,329,139 | B2 | 2/2008 | Benham |
| 7,331,820 | B2 | 2/2008 | Burris et al. |
| 7,335,058 | B1 | 2/2008 | Burris et al. |

(56) References Cited

U.S. PATENT DOCUMENTS 7,347,129 B1 3/2008 Youtsey
7,347,726 B2 3/2008 Wlos
7,347,727 B2 3/2008 Wlos et al.
7,347,729 B2 3/2008 Thomas et al.
7,351,088 B1 4/2008 Qu
7,357,641 B2 4/2008 Kerekes et al.
7,364,462 B2 4/2008 Holland
7,371,112 B2 5/2008 Burris et al.
7,371,113 B2 * 5/2008 Burris ..... H01R 9/0518 439/578
7,375,533 B2 5/2008 Gale
7,387,524 B2 6/2008 Cheng
7,393,245 B2 7/2008 Palinkas et al.
7,396,249 B2 7/2008 Kauffman
7,404,737 B1 7/2008 Youtsey
7,410,389 B2 8/2008 Holliday
7,416,415 B2 8/2008 Hart et al.
7,438,327 B2 10/2008 Auray et al.
7,452,239 B2 11/2008 Montena
7,455,550 B1 11/2008 Sykes
7,458,850 B1 12/2008 Burris et al.
7,458,851 B2 12/2008 Montena
7,462,068 B2 12/2008 Amidon
7,467,980 B2 12/2008 Chiu
7,476,127 B1 1/2009 Wei
7,478,475 B2 1/2009 Hall
7,479,033 B1 1/2009 Sykes et al.
7,479,035 B2 1/2009 Bence et al.
7,484,988 B2 2/2009 Ma et al.
7,484,997 B2 2/2009 Hofling
7,488,210 B1 2/2009 Burris et al.
7,494,355 B2 2/2009 Hughes et al.
7,497,729 B1 3/2009 Wei
7,500,868 B2 3/2009 Holland et al.
7,500,873 B1 3/2009 Hart
7,507,116 B2 3/2009 Laerke et al.
7,507,117 B2 3/2009 Amidon
7,513,788 B2 4/2009 Camelio
7,513,795 B1 * 4/2009 Shaw ..... H01R 9/0521 439/578
7,537,482 B2 5/2009 Burris et al.
7,540,759 B2 6/2009 Liu et al.
7,544,094 B1 6/2009 Paglia et al.
7,563,133 B2 7/2009 Stein
7,566,236 B2 7/2009 Malloy et al.
7,568,945 B2 8/2009 Chee et al.
7,578,693 B2 8/2009 Yoshida et al.
7,588,454 B2 9/2009 Nakata et al.
7,588,460 B2 9/2009 Malloy et al.
7,607,942 B1 10/2009 Van Swearingen
7,625,227 B1 12/2009 Henderson et al.
7,632,143 B1 12/2009 Islam
7,635,283 B1 12/2009 Islam
7,648,383 B2 1/2010 Burris et al.
7,651,376 B2 1/2010 Schreier
7,674,132 B1 3/2010 Chen
7,682,177 B2 3/2010 Berthet
7,682,188 B1 3/2010 Lu
7,694,420 B2 4/2010 Ehret et al.
7,714,229 B2 5/2010 Burris et al.
7,726,996 B2 6/2010 Burris et al.
7,727,011 B2 6/2010 Montena et al.
7,749,021 B2 7/2010 Brodeur
7,749,022 B2 * 7/2010 Amidon ..... H01R 13/6592 439/488
7,753,705 B2 7/2010 Montena
7,753,710 B2 7/2010 George
7,753,727 B1 7/2010 Islam et al.
7,758,356 B2 7/2010 Burris et al.
7,758,370 B1 7/2010 Flaherty
7,794,275 B2 9/2010 Rodrigues
7,806,714 B2 10/2010 Williams et al.
7,806,725 B1 10/2010 Chen
7,811,133 B2 10/2010 Gray
7,814,654 B2 10/2010 Pichler
D626,920 S 11/2010 Purdy et al.
7,824,216 B2 11/2010 Purdy
7,828,594 B2 11/2010 Burris et al.
7,828,595 B2 11/2010 Mathews
7,830,154 B2 11/2010 Gale
7,833,053 B2 11/2010 Mathews
7,845,976 B2 12/2010 Mathews
7,845,978 B1 12/2010 Chen
7,845,980 B1 12/2010 Amidon
7,850,472 B2 12/2010 Friedrich et al.
7,850,487 B1 12/2010 Wei
7,857,661 B1 12/2010 Islam
7,874,870 B1 1/2011 Chen
7,887,354 B2 2/2011 Holliday
7,892,004 B2 2/2011 Hertzler et al.
7,892,005 B2 2/2011 Haube
7,892,024 B1 2/2011 Chen
7,914,326 B2 3/2011 Sutter
7,918,687 B2 4/2011 Paynter et al.
7,927,135 B1 4/2011 Wlos
7,934,954 B1 * 5/2011 Chawgo ..... H01R 9/0524 439/578
7,934,955 B1 5/2011 Hsia
7,938,662 B2 5/2011 Burris et al.
7,942,695 B1 5/2011 Lu
7,950,958 B2 5/2011 Mathews
7,950,961 B2 5/2011 Chabalowski et al.
7,955,126 B2 6/2011 Bence et al.
7,972,158 B2 7/2011 Wild et al.
7,972,176 B2 7/2011 Burris et al.
7,982,005 B2 7/2011 Ames et al.
8,011,955 B1 9/2011 Lu
8,025,518 B2 9/2011 Burris et al.
8,029,315 B2 10/2011 Purdy et al.
8,029,316 B2 10/2011 Snyder et al.
8,037,599 B2 10/2011 Pichler
8,047,872 B2 11/2011 Burris et al.
8,062,044 B2 11/2011 Montena et al.
8,062,063 B2 * 11/2011 Malloy ..... H01R 13/187 439/578
8,070,504 B2 12/2011 Amidon et al.
8,075,337 B2 12/2011 Malloy et al.
8,075,338 B1 12/2011 Montena
8,079,860 B1 12/2011 Zraik
8,087,954 B2 1/2012 Fuchs
8,113,875 B2 2/2012 Malloy et al.
8,113,879 B1 2/2012 Zraik
8,157,587 B2 4/2012 Paynter et al.
8,157,588 B1 4/2012 Rodrigues et al.
8,167,635 B1 5/2012 Mathews
8,167,636 B1 5/2012 Montena
8,172,612 B2 5/2012 Bence et al.
8,177,572 B2 5/2012 Feye-Hohmann
8,192,237 B2 6/2012 Purdy et al.
8,206,172 B2 6/2012 Katagiri et al.
D662,893 S 7/2012 Haberek et al.
8,231,412 B2 7/2012 Paglia et al.
8,262,408 B1 9/2012 Kelly
8,272,893 B2 9/2012 Burris et al.
8,287,310 B2 10/2012 Burris et al.
8,287,320 B2 10/2012 Purdy et al.
8,313,345 B2 11/2012 Purdy
8,313,353 B2 11/2012 Purdy et al.
8,317,539 B2 11/2012 Stein
8,319,136 B2 11/2012 Byron et al.
8,323,053 B2 12/2012 Montena
8,323,058 B2 12/2012 Flaherty et al.
8,323,060 B2 12/2012 Purdy et al.
8,337,229 B2 12/2012 Montena
8,366,481 B2 2/2013 Ehret et al.
8,366,482 B2 2/2013 Burris et al.
8,376,769 B2 2/2013 Holland et al.
D678,844 S 3/2013 Haberek
8,398,421 B2 3/2013 Haberek et al.
8,430,688 B2 4/2013 Montena et al.
8,449,326 B2 5/2013 Holland et al.
8,465,322 B2 6/2013 Purdy
8,469,739 B2 6/2013 Rodrigues et al.
8,469,740 B2 6/2013 Ehret et al.

(56) References Cited

U.S. PATENT DOCUMENTS

D686,164 S 7/2013 Haberek et al.
D686,576 S 7/2013 Haberek et al.
8,475,205 B2 7/2013 Ehret et al.
8,480,430 B2 7/2013 Ehret et al.
8,480,431 B2 7/2013 Ehret et al.
8,485,845 B2 7/2013 Ehret et al.
8,506,325 B2 8/2013 Malloy et al.
8,517,763 B2 8/2013 Burris et al.
8,517,764 B2 8/2013 Wei et al.
8,529,279 B2 9/2013 Montena
8,550,835 B2 10/2013 Montena
8,556,656 B2 * 10/2013 Thomas ..... H01R 9/0521 439/584
8,568,163 B2 10/2013 Burris et al.
8,568,165 B2 10/2013 Wei et al.
8,591,244 B2 11/2013 Thomas et al.
8,597,050 B2 12/2013 Flaherty et al.
8,622,776 B2 1/2014 Morikawa
8,636,529 B2 1/2014 Stein
8,636,541 B2 1/2014 Chastain et al.
8,647,136 B2 2/2014 Purdy et al.
7,114,990 C1 4/2014 Bence et al.
8,690,603 B2 4/2014 Bence et al.
8,721,365 B2 5/2014 Holland
8,727,800 B2 5/2014 Holland et al.
8,758,050 B2 6/2014 Montena
8,777,658 B2 7/2014 Holland et al.
8,777,661 B2 7/2014 Holland et al.
8,834,200 B2 9/2014 Shaw
8,858,251 B2 10/2014 Montena
8,888,526 B2 11/2014 Burris
8,920,192 B2 12/2014 Montena
6,558,194 C1 1/2015 Montena
6,848,940 C1 1/2015 Montena
9,017,101 B2 4/2015 Ehret et al.
8,172,612 C1 5/2015 Bence et al.
9,048,599 B2 6/2015 Burris
9,153,911 B2 10/2015 Burris et al.
9,166,307 B2 10/2015 Shaw
9,166,348 B2 10/2015 Burris et al.
9,172,154 B2 10/2015 Burris
9,172,157 B2 10/2015 Burris
9,306,324 B2 4/2016 Wei
9,343,855 B2 5/2016 Wei
2001/0034143 A1 10/2001 Annequin
2001/0046802 A1 11/2001 Perry et al.
2001/0051448 A1 12/2001 Gonzalez
2002/0013088 A1 1/2002 Rodrigues et al.
2002/0019161 A1 2/2002 Finke et al.
2002/0038720 A1 4/2002 Kai et al.
2002/0064014 A1 5/2002 Montena
2002/0146935 A1 10/2002 Wong
2003/0110977 A1 6/2003 Batlaw
2003/0119358 A1 6/2003 Henningsen
2003/0139081 A1 7/2003 Hall et al.
2003/0194890 A1 10/2003 Ferderer et al.
2003/0214370 A1 11/2003 Allison et al.
2003/0224657 A1 12/2003 Malloy
2004/0031144 A1 2/2004 Holland
2004/0077215 A1 4/2004 Palinkas et al.
2004/0102089 A1 5/2004 Chee
2004/0137778 A1 7/2004 Mattheeuws et al.
2004/0157499 A1 8/2004 Nania et al.
2004/0194585 A1 10/2004 Clark
2004/0209516 A1 10/2004 Burris et al.
2004/0219833 A1 11/2004 Burris et al.
2004/0229504 A1 11/2004 Liu
2005/0026496 A1 2/2005 Islam et al.
2005/0042919 A1 2/2005 Montena
2005/0079762 A1 4/2005 Hsia
2005/0159045 A1 * 7/2005 Huang ..... H01R 9/0524 439/584
2005/0164553 A1 7/2005 Montena
2005/0170692 A1 8/2005 Montena
2005/0181652 A1 8/2005 Montena et al.
2005/0181668 A1 8/2005 Montena et al.
2005/0208827 A1 9/2005 Burris et al.
2005/0233636 A1 10/2005 Rodrigues et al.
2006/0014425 A1 1/2006 Montena
2006/0099853 A1 5/2006 Sattele et al.
2006/0110977 A1 5/2006 Matthews
2006/0113107 A1 6/2006 Williams
2006/0128217 A1 * 6/2006 Burris ..... H01R 9/0518 439/584
2006/0154519 A1 7/2006 Montena
2006/0166552 A1 7/2006 Bence et al.
2006/0178046 A1 8/2006 Tusini
2006/0194465 A1 8/2006 Czikora
2006/0199040 A1 9/2006 Yamada
2006/0223355 A1 10/2006 Hirschmann
2006/0246774 A1 11/2006 Buck
2006/0258209 A1 11/2006 Hall
2006/0276079 A1 12/2006 Chen
2007/0004276 A1 1/2007 Stein
2007/0026734 A1 2/2007 Bence et al.
2007/0049113 A1 3/2007 Rodrigues et al.
2007/0054535 A1 3/2007 Hall et al.
2007/0059968 A1 3/2007 Ohtaka et al.
2007/0082533 A1 4/2007 Currier et al.
2007/0087613 A1 4/2007 Schumacher et al.
2007/0093128 A1 4/2007 Thomas et al.
2007/0123101 A1 5/2007 Palinkas
2007/0155232 A1 7/2007 Burris et al.
2007/0155233 A1 7/2007 Laerke et al.
2007/0173100 A1 7/2007 Benham
2007/0175027 A1 8/2007 Khemakhem et al.
2007/0232117 A1 10/2007 Singer
2007/0243759 A1 10/2007 Rodrigues et al.
2007/0243762 A1 10/2007 Burke et al.
2007/0287328 A1 12/2007 Hart et al.
2008/0032556 A1 2/2008 Schreier
2008/0102696 A1 5/2008 Montena
2008/0171466 A1 7/2008 Buck et al.
2008/0200066 A1 8/2008 Hofling
2008/0200068 A1 8/2008 Aguirre
2008/0214040 A1 9/2008 Holterhoff et al.
2008/0274644 A1 11/2008 Rodrigues
2008/0289470 A1 11/2008 Aston
2008/0310026 A1 12/2008 Nakayama
2009/0029590 A1 1/2009 Sykes et al.
2009/0098770 A1 4/2009 Bence et al.
2009/0104801 A1 4/2009 Silva
2009/0163075 A1 6/2009 Blew et al.
2009/0186505 A1 7/2009 Mathews
2009/0264003 A1 10/2009 Hertzler et al.
2009/0305560 A1 12/2009 Chen
2010/0007441 A1 1/2010 Yagisawa et al.
2010/0022125 A1 1/2010 Burris et al.
2010/0028563 A1 2/2010 Ota
2010/0055978 A1 3/2010 Montena
2010/0080563 A1 4/2010 DiFonzo et al.
2010/0081321 A1 4/2010 Malloy et al.
2010/0081322 A1 4/2010 Malloy et al.
2010/0087071 A1 4/2010 DiFonzo et al.
2010/0105246 A1 4/2010 Burris et al.
2010/0124839 A1 5/2010 Montena
2010/0130060 A1 5/2010 Islam
2010/0178799 A1 7/2010 Lee
2010/0216339 A1 8/2010 Burris et al.
2010/0233901 A1 9/2010 Wild et al.
2010/0233902 A1 9/2010 Youtsey
2010/0233903 A1 9/2010 Islam
2010/0255719 A1 * 10/2010 Purdy ..... H01R 24/40 439/578
2010/0255720 A1 10/2010 Radzik et al.
2010/0255721 A1 10/2010 Purdy et al.
2010/0273351 A1 * 10/2010 Holliday ..... H01R 9/0518 439/584
2010/0279548 A1 11/2010 Montena et al.
2010/0297871 A1 11/2010 Haube
2010/0297875 A1 11/2010 Purdy et al.
2010/0304579 A1 12/2010 Kisling
2010/0323541 A1 12/2010 Amidon et al.
2011/0021072 A1 1/2011 Purdy

(56) References Cited

U.S. PATENT DOCUMENTS

| | | | | |
|---|---|---|---|---|
| 2011/0021075 | A1 | 1/2011 | Orner et al. | |
| 2011/0027039 | A1 | 2/2011 | Blair | |
| 2011/0039448 | A1 | 2/2011 | Stein | |
| 2011/0053413 | A1 | 3/2011 | Mathews | |
| 2011/0074388 | A1 | 3/2011 | Bowman | |
| 2011/0080158 | A1 | 4/2011 | Lawrence et al. | |
| 2011/0111623 | A1 | 5/2011 | Burris et al. | |
| 2011/0111626 | A1 | 5/2011 | Paglia et al. | |
| 2011/0117774 | A1 | 5/2011 | Malloy et al. | |
| 2011/0143567 | A1 | 6/2011 | Purdy et al. | |
| 2011/0151714 | A1 | 6/2011 | Flaherty et al. | |
| 2011/0230089 | A1 | 9/2011 | Amidon et al. | |
| 2011/0230091 | A1 | 9/2011 | Krenceski et al. | |
| 2011/0237123 | A1 | 9/2011 | Burris et al. | |
| 2011/0237124 | A1 | 9/2011 | Flaherty et al. | |
| 2011/0250789 | A1 | 10/2011 | Burris et al. | |
| 2011/0318958 | A1 | 12/2011 | Burris et al. | |
| 2012/0021642 | A1 | 1/2012 | Zraik | |
| 2012/0040537 | A1 | 2/2012 | Burris | |
| 2012/0045933 | A1 | 2/2012 | Youtsey | |
| 2012/0064768 | A1* | 3/2012 | Islam | H01R 9/0521 439/585 |
| 2012/0094530 | A1 | 4/2012 | Montena | |
| 2012/0100751 | A1 | 4/2012 | Montena | |
| 2012/0108098 | A1 | 5/2012 | Burris et al. | |
| 2012/0122329 | A1 | 5/2012 | Montena | |
| 2012/0129387 | A1 | 5/2012 | Holland et al. | |
| 2012/0159740 | A1 | 6/2012 | Strelow et al. | |
| 2012/0171894 | A1 | 7/2012 | Malloy et al. | |
| 2012/0178289 | A1 | 7/2012 | Holliday | |
| 2012/0202378 | A1 | 8/2012 | Krenceski et al. | |
| 2012/0222302 | A1 | 9/2012 | Purdy et al. | |
| 2012/0225581 | A1 | 9/2012 | Amidon et al. | |
| 2012/0315788 | A1 | 12/2012 | Montena | |
| 2012/0329311 | A1 | 12/2012 | Duval et al. | |
| 2013/0059468 | A1* | 3/2013 | Wood | H01R 9/05 439/584 |
| 2013/0065433 | A1 | 3/2013 | Burris | |
| 2013/0072057 | A1 | 3/2013 | Burris | |
| 2013/0178096 | A1 | 7/2013 | Matzen | |
| 2013/0273761 | A1 | 10/2013 | Ehret et al. | |
| 2014/0106612 | A1* | 4/2014 | Burris | H01R 4/304 439/578 |
| 2014/0106614 | A1 | 4/2014 | Burris et al. | |
| 2014/0120766 | A1 | 5/2014 | Meister et al. | |
| 2014/0137393 | A1 | 5/2014 | Chastain et al. | |
| 2014/0148044 | A1 | 5/2014 | Balcer et al. | |
| 2014/0148051 | A1 | 5/2014 | Bence et al. | |
| 2014/0154907 | A1 | 6/2014 | Ehret et al. | |
| 2014/0106613 | A1 | 7/2014 | Burris | |
| 2014/0298650 | A1 | 10/2014 | Chastain et al. | |
| 2014/0322968 | A1 | 10/2014 | Burris | |
| 2014/0342605 | A1 | 11/2014 | Burris et al. | |
| 2015/0118901 | A1* | 4/2015 | Burris | H01R 24/38 439/584 |
| 2015/0295331 | A1 | 10/2015 | Burris | |
| 2016/0118727 | A1 | 4/2016 | Burris et al. | |
| 2016/0118748 | A1 | 4/2016 | Burris et al. | |
| 2017/0025801 | A1 | 1/2017 | Edmonds | |

FOREIGN PATENT DOCUMENTS

| | | | |
|---|---|---|---|
| CN | 1292940 | | 4/2001 |
| CN | 201149936 | | 11/2008 |
| CN | 201149937 | | 11/2008 |
| CN | 201178228 | | 1/2009 |
| CN | 201904508 | | 7/2011 |
| DE | 47931 | | 10/1888 |
| DE | 102289 | | 7/1897 |
| DE | 1117687 | | 11/1961 |
| DE | 2261973 | | 6/1974 |
| DE | 3117320 | | 4/1982 |
| DE | 3117320 | A1 | 4/1982 |
| DE | 3211008 | | 10/1983 |
| DE | 3117320 | C2 | 10/1984 |
| DE | 9001608.4 | | 4/1990 |
| DE | 4439852 | | 5/1996 |
| DE | 19749130 | | 8/1999 |
| DE | 19749130 | C1 | 8/1999 |
| DE | 19957518 | | 9/2001 |
| DE | 10346914 | | 5/2004 |
| DE | 10346914 | A1 | 5/2004 |
| DE | 10346914 | B4 | 5/2004 |
| DE | 102004031271 | | 1/2006 |
| DE | 102010064071 | | 12/2010 |
| EP | 115179 | | 8/1984 |
| EP | 115179 | A3 | 8/1984 |
| EP | 116157 | | 8/1984 |
| EP | 167738 | | 1/1986 |
| EP | 72104 | | 2/1986 |
| EP | 223464 | | 5/1987 |
| EP | 265276 | | 4/1988 |
| EP | 299772 | A2 | 1/1989 |
| EP | 299772 | A3 | 1/1989 |
| EP | 350835 | | 1/1990 |
| EP | 350835 | A2 | 1/1990 |
| EP | 350835 | A3 | 1/1990 |
| EP | 428424 | | 5/1991 |
| EP | 867978 | | 9/1998 |
| EP | 867978 | A2 | 9/1998 |
| EP | 867978 | A3 | 9/1998 |
| EP | 1069654 | | 9/1998 |
| EP | 1069654 | A1 | 1/2001 |
| EP | 1094565 | | 4/2001 |
| EP | 1094565 | A1 | 4/2001 |
| EP | 1115179 | | 7/2001 |
| EP | 1115179 | A2 | 7/2001 |
| EP | 1115179 | A3 | 7/2001 |
| EP | 1191268 | | 3/2002 |
| EP | 1069654 | B1 | 10/2002 |
| EP | 1455420 | | 9/2004 |
| EP | 1455420 | A1 | 9/2004 |
| EP | 1501159 | | 1/2005 |
| EP | 1548898 | | 6/2005 |
| EP | 1603200 | | 12/2005 |
| EP | 1455420 | B1 | 5/2006 |
| EP | 1701410 | | 9/2006 |
| EP | 2051340 | | 4/2009 |
| FR | 2204331 | | 5/1974 |
| FR | 2204331 | A5 | 5/1974 |
| FR | 2232846 | | 1/1975 |
| FR | 2462798 | | 2/1981 |
| FR | 2494508 | | 5/1982 |
| GB | 589697 | | 6/1947 |
| GB | 1010372 | | 11/1963 |
| GB | 1087228 | | 10/1967 |
| GB | 1270846 | | 4/1972 |
| GB | 1332888 | | 10/1973 |
| GB | 1401373 | | 7/1975 |
| GB | 1421215 | | 1/1976 |
| GB | 2019665 | | 10/1979 |
| GB | 2079549 | | 1/1982 |
| GB | 2252677 | | 8/1992 |
| GB | 2264201 | | 8/1993 |
| GB | 2331634 | | 5/1999 |
| GB | 2448595 | | 10/2008 |
| GB | 2450248 | | 12/2008 |
| JP | 3280369 | | 12/1991 |
| JP | 2000-40564 | | 2/2000 |
| JP | 2002-015823 | | 1/2002 |
| JP | 200215823 | | 1/2002 |
| JP | 4129978 | | 8/2008 |
| JP | 4219778 | | 2/2009 |
| JP | 2009277571 | | 11/2009 |
| JP | 4391268 | | 12/2009 |
| JP | 4503793 | | 7/2010 |
| KR | 100622526 | | 9/2006 |
| TW | 427044 | | 3/2001 |
| TW | 200810279 | | 2/2008 |
| TW | 200843262 | | 11/2008 |
| TW | 201140953 | | 11/2011 |
| WO | 8700351 | | 1/1987 |
| WO | 9908343 | | 2/1999 |

(56) References Cited

FOREIGN PATENT DOCUMENTS

| | | | |
|---|---|---|---|
| WO | 00/05785 | | 2/2000 |
| WO | 0005785 | A1 | 2/2000 |
| WO | 186756 | | 11/2001 |
| WO | 2069457 | | 9/2002 |
| WO | 2004013883 | | 2/2004 |
| WO | 2004098795 | | 11/2004 |
| WO | 2006081141 | | 8/2006 |
| WO | 2007062845 | | 6/2007 |
| WO | 2009066705 | | 5/2009 |
| WO | 2010135181 | | 11/2010 |
| WO | 2011057033 | | 5/2011 |
| WO | 2012162431 | | 5/2011 |
| WO | 2011128665 | | 10/2011 |
| WO | 2011128666 | | 10/2011 |
| WO | 2013126629 | | 8/2013 |

OTHER PUBLICATIONS

Search Report dated Mar. 19, 2013 pertaining to International application No. PCT/US2013/20001.
Office Action dated Feb. 29, 2016 pertaining to U.S. Appl. No. 14/795,367.
Office Action dated May 3, 2016 pertaining to U.S. Appl. No. 14/750,435.
Office Action dated May 20, 2016 pertaining to U.S. Appl. No. 13/927,537.
Chinese Search Report dated Jan. 19, 2016 pertaining to Chinese Application No. 2013800048358.
Taiwan Search Report dated Mar. 28, 2016 pertaining to Taiwanese Application No. 102100147.
Corning Gilbert 2004 OEM Coaxial Products Catalog, Quick Disconnects, 2 pages.
Digicon AVL Connector. Arris Group Inc. [online] 3 pages. Retrieved from the Internet: <URL: http://www.arrisi.com/special/digiconAVL.asp.
U.S. Office Action, U.S. Appl. No. 10/997,218; dated Jul. 31, 2006, pp. 1-10.
Society of Cable Telecommunications Engineers, Engineering Committee, Interface Practices Subcommittee; American National Standard; ANSI/SCTE 01 2006; Specification for "F" Port, Female, Outdoor. Published Jan. 2006. 9 pages.
The American Society of Mechanical Engineers; "Lock Washers (Inch Series), An American National Standard"; ASME 818.21.1-1999 (Revision of ASME B18.21.1-1994); Reaffirmed 2005. Published Feb. 11, 2000. 28 pages.
Notice of Allowance (dated Mar. 20, 2012) for U.S. Appl. No. 13/117,843.
Search Report dated Jun. 6, 2014 pertaining to International application No. PCT/US2014/023374.
Search Report dated Apr. 9, 2014 pertaining to International application No. PCT/US2014/015934.
Society of Cable Telecommunications Engineers, Engineering Committee, Interface Practices Subcommittee; American National Standard; ANSI/SCTE 02 2006; "Specification for "F" Port, Female, Indoor". Published Feb. 2006. 9 pages.
PPC, "Next Generation Compression Connectors," pp. 1-6, Retrieved from http://www.tessco.com/yts/partnearnanufacturer list/vendors/ppc/pdf/ppc digital spread.pdf.
Patent Cooperation Treaty, International Search Report for PCT/US2013/070497, dated Feb. 11, 2014, 3 pgs.
Patent Cooperation Treaty, International Search Report for PCT/US2013/064515, 10 pgs.
Patent Cooperation Treaty, International Search Report for PCT/US2013/064512, dated Jan. 21, 2014, 11 pgs.
Huber+Suhner AG, RF Connector Guide: Understanding connector technology, 2007, Retrieved from http://www.ie.itcr.ac.cr/marin/lic/e14515/HUBER+SUENER_RF_Connector_Guide.pdf.
Slade, Paul G,. Electrical Contacts: Principles and Applications, 1999, Retrieved from http://books.google.com/books (table of contents only).
U.S. Reexamination Control No. 95/002,400 filed Sep. 15, 2012, regarding U.S. Pat. No. 8,192,237 filed Feb. 23, 2011 (Purdy et al.).
U.S. Inter Partes Review Case No. 2013-00346 filed Jun. 10, 2013, regarding U.S. Pat. No. 8,287,320 filed Dec. 8, 2009, claims 1-8, 10-16, 18-31 (Purdy et al.).
U.S. Inter Partes Review Case No. 2013-00343 filed Jun. 10, 2013, regarding U.S. Pat. No. 8,313,353 filed Apr. 30, 2012, claims 1-6 (Purdy et al.).
U.S. Inter Partes Review Case No. 2013-00340 filed Jun. 10, 2013, regarding U.S. Pat. No. 8,323,060 filed Jun. 14, claims 1-9 (Purdy et al.).
U.S. Inter Partes Review Case No. 2013-00347 filed Jun. 10, 2013, regarding U.S. Pat. No. 8,287,320 filed Dec. 8, 2009, claims 9, 17, 32 (Purdy et al.).
U.S. Inter Partes Review Case No. 2013-00345 filed Jun. 10, 2013, regarding U.S. Pat. No. 8,313,353 filed Apr. 30, 2012, claims 7-27 (Purdy et al.).
U.S. Inter Partes Review Case No. 2013-00342 filed Jun. 10, 2013, regarding U.S. Pat. No. 8,323,060 filed Jun. 14, 2012, claims 10-25 (Purdy et al.).
U.S. Inter Partes Review Case No. 2014-00441 filed Feb. 18, 2014, regarding U.S. Pat. No. 8,562,366 filed Oct. 15, 2012, claims 31,37, 39, 41, 42, 55 56 (Purdy et al.).
U.S. Inter Partes Review Case No. 2014-00440 filed Feb. 18, 2014, regarding U.S. Pat. No. 8,597,041 filed Oct. 15, 2012, claims 1, 8, 9, 11, 18-26, 29 (Purdy et al.).
Office Action dated Jun. 12, 2014 pertaining to U.S. Appl. No. 13/795,737.
Office Action dated Aug. 25, 2014 pertaining to U.S. Appl. No. 13/605,481.
Election/Restrictions Requirement dated Jul. 31, 2014 pertaining to U.S. Appl. No. 13/652,969.
Office Action dated Aug. 29, 2014 pertaining to U.S. Appl. No. 13/827,522.
Election/Restrictions Requirement dated Jun. 20, 2014 pertaining to U.S. Appl. No. 13/795,780.
Office Action dated Sep. 19, 2014 pertaining to U.S. Appl. No. 13/795,780.
Office Action dated Oct. 6, 2014 pertaining to U.S. Appl. No. 13/732,679.
Corning Cabelcon waterproof CX3 7.0 QuickMount for RG6 cables; Cabelcon Connectors; www.cabelcom.dk; Mar. 15, 2012.
Maury Jr., M.; Microwave Coaxial Connector Technology: A Continuaing Evolution; Maury Microwave Corporation; Dec. 13, 2005; pp. 1-21; Maury Microwave Inc.
"Snap-On/Push-On" SMA Adapter; RF TEC Mfg., Inc.; Mar. 23, 2006; 2 pgs.
RG6 quick mount data sheet; Corning Cabelcon; 2010; 1 pg.; Corning Cabelcon ApS.
RG11 quick mount data sheet; Corning Cabelcon; 2013; 1 pg.; Corning Cabelcon ApS.
Gilbert Engineering Co., Inc.; OEM Coaxial Connectors catalog; Aug. 1993; p. 26.
UltraEase Compression Connectors; "F" Series 59 and 6 Connectors Product Information; May 2005; 4 pgs.
Pomona Electronics Full Line Catelog; vol. 50; 2003; pp. 1-100.
Office Action dated Dec. 31, 2014 pertaining to U.S. Appl. No. 13/605,498.
Office Action dated Dec. 16, 2014 pertaining to U.S. Appl. No. 13/653,095.
Office Action dated Dec. 19, 2014 pertaining to U.S. Appl. No. 13/652,969.
Office Action dated Dec. 29, 2014 pertaining to U.S. Appl. No. 13/833,793.
Notice of Allowance dated Feb. 2, 2015 pertaining to U.S. Appl. No. 13/795,737.
Office Action dated Feb. 25, 2015 pertaining to U.S. Appl. No. 13/605,481.
Office Action dated Feb. 18, 2015 pertaining to U.S. Appl. No. 13/827,522.
Office Action dated Mar. 19, 2015 pertaining to U.S. Appl. No. 13/795,780.

(56) References Cited

OTHER PUBLICATIONS

Patent Cooperation Treaty, International Search Report for PCT/US2014/037841, dated Aug. 19, 2014, 3 pages.
Office Action dated Jun. 24, 2015 pertaining to U.S. Appl. No. 13/652,969.
Patent Cooperation Treaty, International Preliminary Report on Patentability for PCT/US2013/064512, dated Apr. 30, 2015, 9 pages.
Patent Cooperation Treaty, International Preliminary Report on Patentability for PCT/US2013/064515, dated Apr. 30, 2015, 8 pages.
Office Action dated Jun. 24, 2015 pertaining to U.S. Appl. No. 14/259,703.
Office Action dated Jul. 20, 2015 pertaining to U.S. Appl. No. 14/279,870.
Office Action dated Feb. 2, 2016 pertaining to U.S. Appl. No. 14/259,703.
Office Action dated Oct. 7, 2015 pertaining to U.S. Appl. No. 13/927,537.
Search Report dated Oct. 7, 2014 pertaining to International application No. PCT/US2014/043311.
Report on the Filing or Determination of an Action Regarding a Patent or Trademark regarding U.S. Pat. Nos. 8,313,353; 8,313,345; 8,323,060—Eastern District of Arkansas.
Report on the Filing or Determination of an Action Regarding a Patent or Trademark regarding U.S. Pat. Nos. 8,192,237; 8,287,320; 8,313,353; 8,323,060—Northern District of New York.
Report on the Filing or Determination of an Action Regarding a Patent or Trademark regarding U.S. Pat. No. 8,562,366—Northern District of New York.
Office Action dated Mar. 10, 2016 pertaining to U.S. Appl. No. 14/166,653.
International Search Report and Written Opinion of the International Searching Authority; PCT/US2016/017294; dated May 11, 2016.
TW102137009 Search Report dated Sep. 26, 2016; 1 page, Taiwan Patent Office.
Office Action dated Jan. 20, 2017 pertaining to U.S. Appl. No. 14/797,575.
Apple Rubber Products Seal Design Guide 75; Mary K. Chaffee et al eds.; 2009; available at http://www.applerubber.com/src/pdf/seal-design-guide.pdf.
Whitlock, J. et al.; The Seal Man's O'Ring Handbook; Eric Jackson ed.; EPM, Inc.; 1st ed. 2004; pp. 1-36; available at https://www.physics.harvard.edu/uploads/files/machineshop/epm_oring_handbook.pdf.
O-Ring Identification Chart; Universal Air Conditioner, Inc.; available at https://www.uacparts.com/Downloads/UAC%20Oring%20Chart.pdf.
Office Action dated May 5, 2017 pertaining to U.S. Appl. No. 15/255,625.
Office Action dated Jul. 25, 2017 pertaining to U.S. Appl. No. 14/259,703.
Ex Parte Quayle dated May 18, 2017 pertaining to U.S. Appl. No. 15/342,709.
Office Action dated May 9, 2017 pertaining to U.S. Appl. No. 14/884,385.
Corning Cablecon CX3™ Compression Catalogue; Rev. May 2012; 16 Pages.
Office Action dated Aug. 26, 2016 pertaining to U.S. Appl. No. 15/019,498.
Office Action dated Sep. 1, 2016 pertaining to U.S. Appl. No. 14/259,703.
Office Action dated Sep. 23, 2016 pertaining to U.S. Appl. No. 14/872,842.
Notice of Allowance dated Sep. 23, 2016 pertaining to U.S. Appl. No. 13/927,537.
Notice of Allowance dated Sep. 19, 2016 pertaining to U.S. Appl. No. 14/928,552.
Office Action dated Jul. 5, 2016 pertaining to U.S. Appl. No. 14/795,367.
Office Action dated Nov. 7, 2016 pertaining to U.S. Appl. No. 15/278,825.

* cited by examiner

COAXIAL CABLE CONNECTOR

BACKGROUND

Field

The present disclosure generally relates to coaxial cable connectors, and, more particularly, to coaxial connectors and cables assemblies with conductor retaining members.

Technical Background

Coaxial cable connectors, such as F-connectors, are used to attach coaxial cables to another object such as an appliance or junction having a terminal adapted to engage the connector. For example, F-connectors are often used to terminate a drop cable in a cable television system. The coaxial cable typically includes an inner conductor surrounded by a dielectric layer, which is in turn surrounded by a conductive grounding foil and/or braid defining an outer conductive grounding sheath. The outer conductive grounding sheath is itself surrounded by a protective outer jacket. The F-connector is typically secured over a prepared end of the jacketed coaxial cable, allowing the end of the coaxial cable to be connected with a terminal block, such as by a threaded connection with a threaded terminal of a terminal block.

Crimp style F-connectors including a crimp sleeve as part of a connector body are known. A special radial crimping tool, having jaws that form a hexagon, is typically used to radially crimp the crimp sleeve around the outer jacket of the coaxial cable to secure the crimp style F-connector over the prepared end of the coaxial cable.

Still another form of F-connector uses a radial compression sleeve to secure the F-connector over the prepared end of the cable. Rather than crimping a crimp sleeve radially toward the jacket of the coaxial cable, these F-connectors employ a plastic annular compression sleeve that is mounted inside of the F-connector. The compression sleeve includes an inner bore that is driven radially inwardly by a connector body when the annular compression sleeve is moved from a starting position to an ending position by means of an axial compression tool. The end of the coaxial cable is prepared by removing a portion of the outer braid and/or folding the outer braid back over the cable jacket. The F-connector itself is then inserted over the prepared end of the coaxial cable.

The step of flaring and folding the braided outer conductive grounding sheath over the outer jacket can be a time consuming and painstaking process. Further, small fragments of the outer braid may break off. These small fragments may cause electrical shorts in nearby electrical systems and/or enter the skin of cable installer.

Accordingly, alternative connectors that do not require that the braided outer conductive grounding sheath be folded over the jacket may be desired.

SUMMARY

Embodiments of coaxial cable connectors that may be connected to a coaxial cable without requiring that a braided outer conductive grounding sheath be folded back over an outer jacket layer of the coaxial cable are provided.

In some embodiments, for example, an electrically conductive retainer is configured to contact and retain the cable braided outer conductive grounding sheath within a coaxial cable connector upon insertion of a coaxial cable into the connector and a subsequent compression of said connector. In one example embodiment, for example, a conductive retainer of a coaxial cable connector is configured to contact and axially clamp a braided outer conductive grounding sheath within the connector to retain the braided outer conductive grounding sheath within the connector and provide an electrical ground path from the braided outer conductive grounding sheath to a retainer and associated components of the coaxial cable connector.

In an example embodiment, for example, a coaxial cable connection is configured to provide a continual ground path from a cable outer conductor grounding structure to a rotatable coupler of the connector. In other particular embodiment, for example, a protrusion member extends from a retainer of a coaxial cable connector and is interposed in an end-wise fashion between a foil outer conductor layer of the coaxial cable and the braided outer conductive grounding sheath. In other example embodiments, a push-on type connector interface is incorporated to engage a mating port without the use of a rotatable coupler. Embodiments of coaxial cable connectors may also be configured to position a cable core and electrically tune the connector/cable coaxial structure.

In one embodiment, for example, a connector, for example, may include a coupler comprising an inner surface defining an coupler inner bore; a retainer comprising an inner surface defining a retainer inner bore configured to receive the inner conductor and insulator layer of a coaxial cable and an outer angled rear facing surface configured to extend between the insulator layer and the outer conductor layer of the coaxial cable, the retainer disposed within the inner bore of the coupler; a hub engaged to the retainer and disposed at least partially within the inner bore of the coupler, the hub rotatably engaged with the coupler, the hub further comprising an outer angled forward facing surface at least partially opposing the outer angled rear facing surface of the retainer, wherein the outer angled rear facing surface of the retainer and the outer angled forward facing surface of the hub are configured to secure the outer conductor layer between the outer angled rear facing surface of the retainer and the outer angled forward facing surface of the hub.

In another embodiment, a method for securing a cable or conduit in a connector is provided. The method includes inserting a coaxial cable through inner bores of a collar, a gripping member, a body and a hub. An inner conductor and insulator of the coaxial cable extend through a retainer. An outer conductor of the coaxial cable extends between the retainer and the hub along a rearward facing edge of the retainer. The method also includes sliding the collar relative to the body. The collar includes a surface extending inwardly from an inner surface of the collar. The surface is disposed adjacent to and contacting a rear end of the gripping member. The collar surface pushes the gripping member at least partially into a rear end of the body.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description are merely exemplary, and are intended to provide an overview or framework to understanding the nature and character of the claims. The accompanying drawings are included to provide a further understanding, and are incorporated in and constitute a part of this specification. The drawings illustrate embodiments, and together with the description serve to explain principles and operation of the various embodiments.

DETAILED DESCRIPTION

Embodiments of coaxial cable connectors configured to be installed on a coaxial cable having limited preparation performed on the coaxial cable are provided. In some embodiments, for example, the coaxial cable connectors do not require that an outer conductor layer, such as a braided outer conductive grounding sheath (braid), of the coaxial cable be folded back over an outer jacket of the coaxial cable. Various embodiments of connectors and coaxial cable assemblies are described in detail below.

Figure 1:
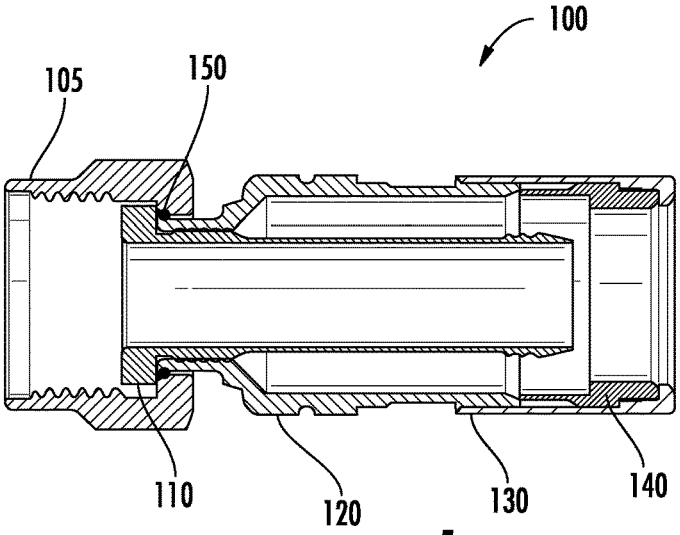
FIG. 1 schematically depicts a partial cross section of an example coaxial cable connector.

Referring now to FIG. 1 wherein FIG. 1 schematically depicts a partial cross section of an example coaxial cable connector 100. In this particular example, the coaxial cable connector 100 includes a coupler 105 rotatably engaged about a shoulder of a separate post 110. The coaxial cable connector 100 further includes a body 120 disposed at least partially around the post 110. In the coaxial cable connector 100, a collar 130 is disposed at least partially around an end of the body 120 and a gripping member 140 is disposed between the collar and body as shown in FIG. 1. The coupler 105, for example, may be made of metal such as brass and plated with a conductive material such as nickel. The post 110 may be made of metal such as brass and plated with a conductive material such as tin. The body 120 may be made of metal such as brass and plated with a conductive material such as nickel. An O-ring 150 may also be disposed between the coupler 105 and body 120 as shown in FIG. 1 to seal the connector. In one example, the coaxial cable connector is a commercially available coaxial cable connector known as an UltraRange Type F connector produced by Corning Optical Communications RF and described in U.S. Pat. No. 701,823 and U.S. Pat. No. 7,182,639.

Figure 2:
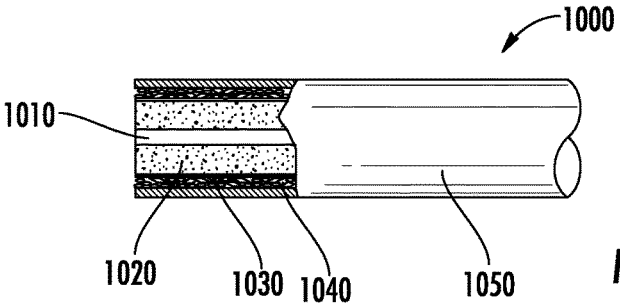
FIG. 2 schematically depicts a partial cross section of a coaxial cable.

FIG. 2 illustrates an example coaxial cable 1000 schematically illustrated in a partial cutaway view. The example coaxial cable 1000 comprises an inner conductor 1010 surrounded by an insulator layer 1020. In some embodiments the inner conductor 1010 is copper-clad aluminum, though the inner conductor 1010 may be a conductor other than copper-clad aluminum (e.g., copper, gold, or the like) in other embodiments. In some embodiments, the dielectric/insulator layer 1020 is a plastic, though the insulator layer 1020 may be an insulator other than plastic in other embodiments. The insulator layer 1020 may also have a foil or other metallic covering 1030 in some embodiments. The coaxial cable 1000 further comprises a braided outer conductor layer 1040 which is covered and protected by an outer layer 1050 (i.e., a cable jacket). In some embodiments, the covering 1030 and the outer conductor layer 1050 is aluminum, though the covering 1030 and/or the outer conductor layer 1050 may be a conductor other than aluminum in other embodiments. In some embodiments, the outer jacket 1050 is an insulator, such as, but not limited to plastic. The outer jacket 1050 may comprise, for example, polyethylene and/or other plastic.

Figure 2A:
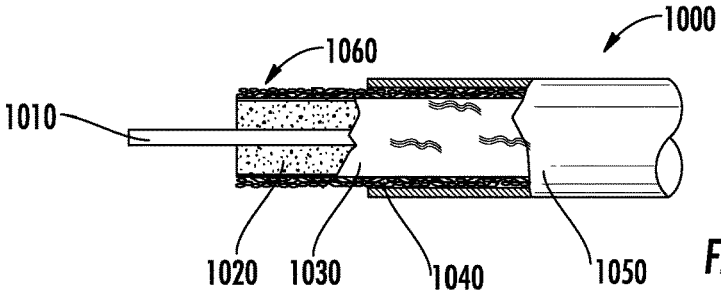
FIG. 2A schematically depicts a cross sectional view of an example of a prepared coaxial cable.

FIG. 2A schematically illustrates a cross-sectional view of the example coaxial cable 1000 of FIG. 2 in which a stripped portion 1060 of the outer jacket 1050 of the coaxial cable 1000 is stripped from the coaxial cable 1000 resulting in the braided outer conductor layer 1040 being exposed.

Figure 2B:
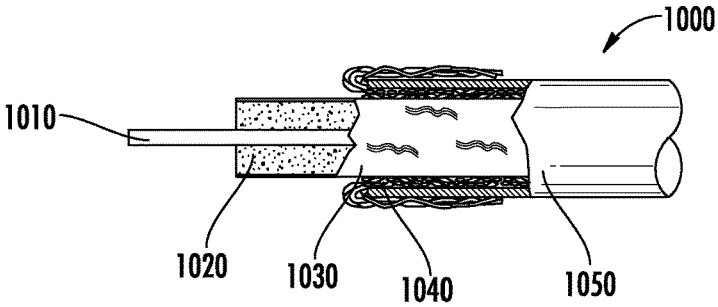
FIG. 2B schematically depicts a cross sectional view of another example of a prepared coaxial cable.

FIG. 2B schematically illustrates a cross-sectional view of the example coaxial cable 1000 of FIGS. 2 and 2A in which a braided outer conductor layer 1040 exposed at the stripped portion 1060 of the coaxial cable 1000 is subsequently folded back over the cable jacket 1050. Folding back of cable braid 1040 is part of the current state of the art cable preparation method. The step of flaring and folding the braided outer conductive grounding sheath over the outer jacket can be a time consuming and painstaking process. Further, small fragments of the outer braid may break off. These small fragments may cause electrical shorts in nearby electrical systems and/or enter the skin of cable installer. As a result, embodiments of coaxial cable connectors are provided that may be installed on a cable prepared as illustrated in FIG. 2A and thus eliminate the need to further prepare the cable as described in FIG. 2B.

Figure 3:
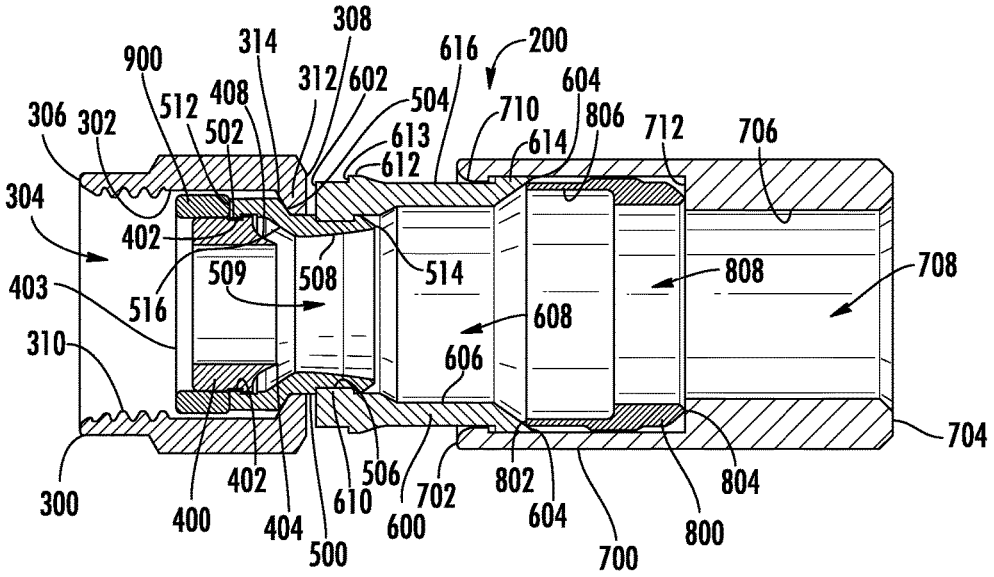
FIG. 3 schematically depicts a cross sectional view of an example coaxial cable connector according to one or more embodiments described and illustrated herein.

FIG. 3 schematically depicts a cross sectional view of an example coaxial cable connector 200 according to one or more embodiments described and illustrated herein. In this embodiment, the coaxial cable connector 200 at least partially comprises a coupler 300 configured to connect the coaxial cable connector to a terminal of an appliance or junction of a coaxial cable system. A retainer 400 is disposed at least partially within an inner bore of the coupler 300. A hub 500 is engaged with the retainer 400 and is also at least partially disposed within the inner bore of the coupler 300. A body 600 is disposed at least partially radially externally to a rearward portion of the hub 500 and includes an inner bore configured to receive a prepared end of a coaxial cable. A radially inwardly extending protrusion of the body 600 is configured to engage an annular groove of the hub 500. A collar 700 is disposed at least partially around a rear end of the body 600 and is configured to move axially around an outer surface of the body 600 as described in further detail below. As shown in FIG. 3, a gripping member 800 is disposed within an inner bore of the collar 700 and generally adjacent to a rear end of the body 600. FIG. 3 further shows a gasket 900 that may be used in some embodiments to provide a seal between the retainer 400 and the coupler 300.

In one embodiment, the coupler 300, retainer 400, hub 500 may be made from nickel plated brass or the like. The body 600 may be made from plastic such as acetal as a non-limiting example, or alternatively, nickel plated brass. Collar 700 may be made from plastic, or alternatively, nickel plated brass. Gripping member 800 may be made from plastic such as acetal as a non-limiting example. The gasket 900 may be made from EPDM or the like.

In the embodiment shown in FIG. 3, for example, the coupler 300 comprises an inner surface 302 defining a longitudinal inner bore 304 extending through the coupler 300 from a first forward end 306 to a second rearward end 308. In this particular embodiment, for example, the inner surface 302 of the coupler 300 further comprises threads 310 extending at least partially along the inner surface 302 such that the coupler is configured to rotatably engage the terminal of the appliance or junction of the coaxial cable system, wherein the coupler 300 may be referred to as a nut, although in other implementations the coupler may be configured to slidably engage the terminal. The rear end 308 of the coupler 300 comprises a tail flange 312. The tail flange 312 comprises a forward facing portion 314 configured to axially engage a flange of the hub 500, thereby preventing the coupler 300 from axially sliding off the front end of the hub 500 and retainer 400.

The retainer 400 comprises a first forward end 403 and a second rearward end 404. An inner surface of the retainer 400 defines a longitudinal bore extending through the retainer 400 and is configured to receive a prepared end of a coaxial cable. In the embodiment shown in FIG. 3, for example, the retainer 400 comprises an annular groove 402 configured to receive a radial protrusion 502 of the hub 500 to rotatably or non-rotatably engage the retainer 400 to the hub 500. The coupled retainer 400 and hub 500 extend at least partially into the inner bore of the coupler 200 and extend in a second rearward direction from the coupler 300. The hub 500 comprises a first forward end 512 and a second rear end 514. The hub 500 further comprises an inner surface 508 defining a longitudinal inner bore extending through the hub from the first forward end 512 to the second rear end 514. The hub 500 also comprises a rearward facing wall 504 configured to rotatably or non-rotatably engage a forward facing face 314 of the flange 312 of the coupler 300 that extends radially inwardly from an outer surface of the coupler 300 and prevents the coupler 300 from moving forwardly relative to the retainer 400 and the hub 500.

Figure 7:
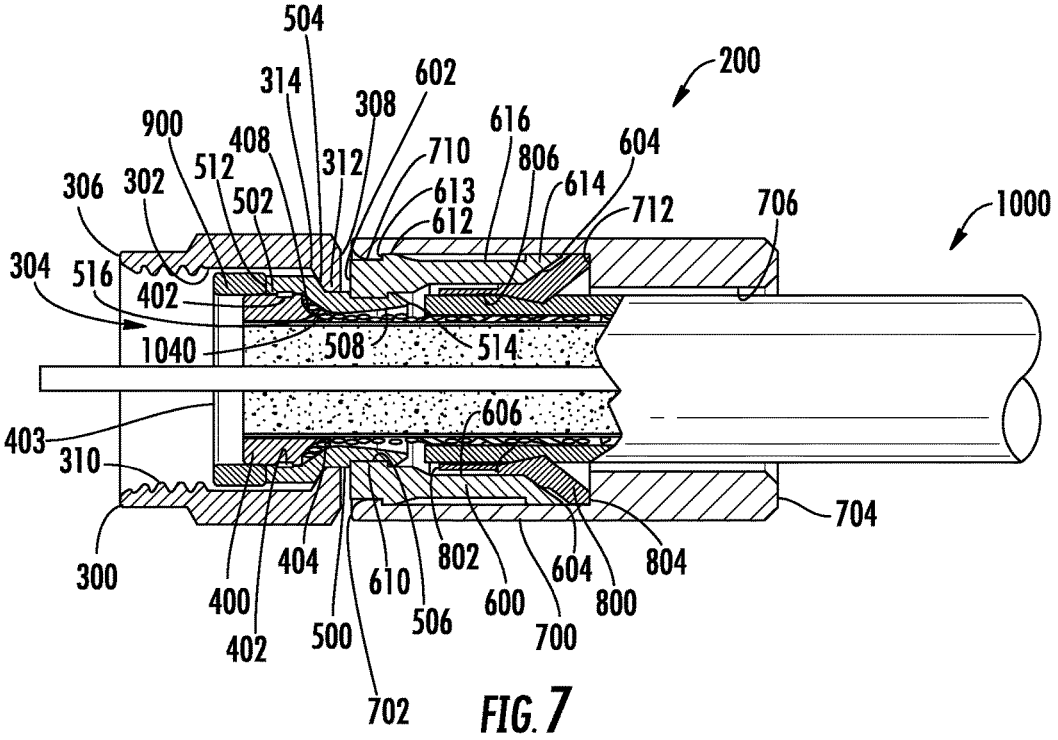
FIG. 7 schematically depicts a cross sectional view of the example coaxial cable connector depicted in FIG. 3 with a coaxial cable fully inserted therein and the connector fully compressed according to one or more embodiments described and illustrated herein.

As is shown in FIG. 7, the retainer 400 and hub 500 each comprise generally opposing angled surfaces 408 and 516 of the retainer 400 and hub 500, respectively. The generally opposing angled surfaces 408 and 516 together define a gap disposed between the surfaces 408 and 516 configured to receive and engage an outer conductor layer (e.g., braided outer conductor layer) of a prepared end of a coaxial cable inserted into the coaxial cable connector 200 (see, e.g., FIG. 7).

The body 600 comprises a first forward end 602 and a second rearward end 604, and an inner surface 606 defining a longitudinal inner bore 608 extending through the body from the first end 602 to the second end 604. The body further comprises a flange 610 disposed generally at the first forward end 602 extending radially inwardly to rotatably or non-rotatably engage an annular groove 506 of the hub 500. The body also includes a first forward shoulder 612 and a second rearward shoulder 614 each extending radially outwardly from an outer surface 616 of the body 600. The outer surface 616 extends longitudinally between the first forward shoulder 612 and the second rearward shoulder 614. The first forward shoulder 612 and the second rearward shoulder 614 are configured to engage an inwardly extending flange 710 of the collar 700 to limit movement of the collar 700 in a first forward direction and a second rearward direction, respectively. In the particular embodiment shown in FIG. 3, for example, the first forward shoulder 612 includes a forward facing surface 613 configured to engage the inwardly extending flange 710 of the collar such that the flange 710 is configured to slide over the first forward shoulder 612 and latch over the first forward shoulder 612 at the forward facing surface 613 when the collar 700 is compressed over the body 600 and holding the collar 700 and body in the compressed configuration. The second rearward shoulder 614, for example, is configured to prevent the collar 700 from sliding off the rear end 604 of the body 600.

The collar 700 comprises a first forward end 702, a second rearward end 704 and an inner surface 706 defining a longitudinal inner bore 708 extending through the collar 700 from the first end 702 to the second end 704. The body further comprises a flange 710 disposed generally at the first forward end 702 extending radially inwardly to slidably engage the outer surface 616 of the body 600. The flange 710 is configured to slide along the outer surface 616 of the body between the first forward shoulder 612 and the second rearward shoulder 614, each of which acts as a stop for the relative movement of the body 600 and collar 700 in the first forward and second rearward directions, respectively. Further, in the particular embodiment shown in FIG. 3, for example, the first forward shoulder 612 includes a forward facing surface 613 configured to engage the inwardly extending flange 710 of the collar such that the flange 710 is configured to slide over the first forward shoulder 612 and latch over the first forward shoulder 612 at the forward facing surface 613 when the collar 700 is compressed over the body 600 and holding the collar 700 and body in the compressed configuration.

The gripping member 800 comprises a first forward end 802, a rearward end 804 and an inner surface 806 defining a longitudinal inner bore 808 extending through the gripping member 800 from the first end 802 to the second end 804. The gripping member 800 is disposed within the longitudinal inner bore 708 of the collar 700 between and generally adjacent to the rear end 604 of the body 600 and an internal radially inwardly extending surface 712 of the collar 700. As described in more detail below, the gripping member 800 is configured to be driven into the longitudinal inner bore 608 of the body 600 by the radially inwardly extending surface 712 of the collar 700 as the collar is slid in a forward direction relative to the body 600. U.S. Pat. No. 7,182,639 issued on Feb. 27, 2007 further describes example gripping members that may be used within the design of a coaxial cable connector and is incorporated by reference in its entirety as if fully set forth herein.

Figure 4:
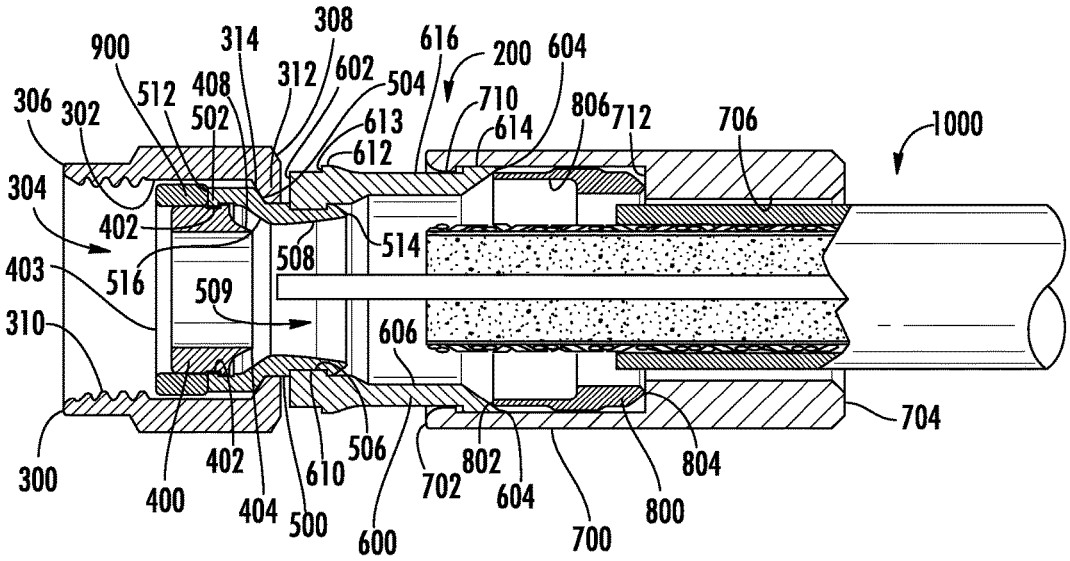
FIG. 4 schematically depicts a cross sectional view of the example coaxial cable connector depicted in FIG. 3 with a coaxial cable prepared as shown in FIG. 2A partially inserted therein according to one or more embodiments described and illustrated herein.

FIG. 4 schematically depicts a cross sectional view of the example coaxial cable connector 200 depicted in FIG. 3 with a coaxial cable 1000 prepared as shown in FIG. 2B and at least partially inserted. Preparation as illustrated in FIG. 2A is significantly easier and quicker to accomplish as compared to FIG. 2B as folding back of braid 1040 is not required.

Figure 5:
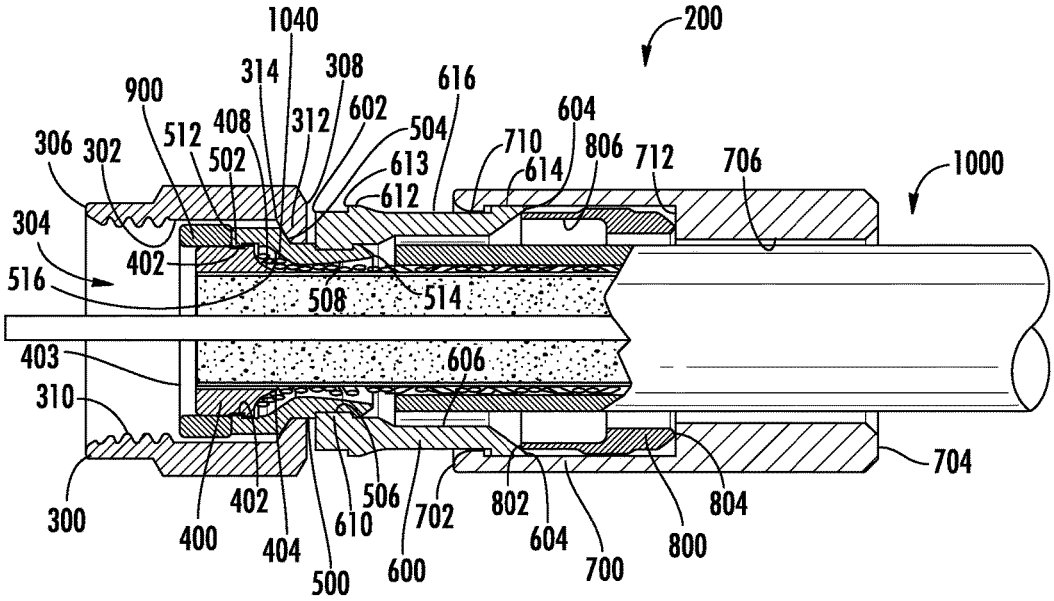
FIG. 5 schematically depicts a cross sectional view of the example coaxial cable connector depicted in FIG. 3 with a coaxial cable fully inserted therein according to one or more embodiments described and illustrated herein.

FIG. 5 schematically depicts a cross sectional view of the example coaxial cable connector 200 depicted in FIGS. 3 and 4 with the coaxial cable 1000 fully inserted therein. The inner conductor 1010 surrounded by an insulator layer 1020, a metallic covering 1030, a braided outer conductor layer 1040 and an outer jacket 1050, which has been stripped from the end of the coaxial cable as described above with reference to FIG. 2A. The inner conductor 101, insulator layer 1020 and metallic covering 1030 are inserted into inner bore of retainer 400 while braided outer conductor layer 1040 is arrayed along tapered surface of retainer 400. The braided outer conductor layer 1040 is disposed in an annular gap defined between the angled surfaces 408 and 516 of the retainer 400 and the hub 500, respectively.

Figure 6A:
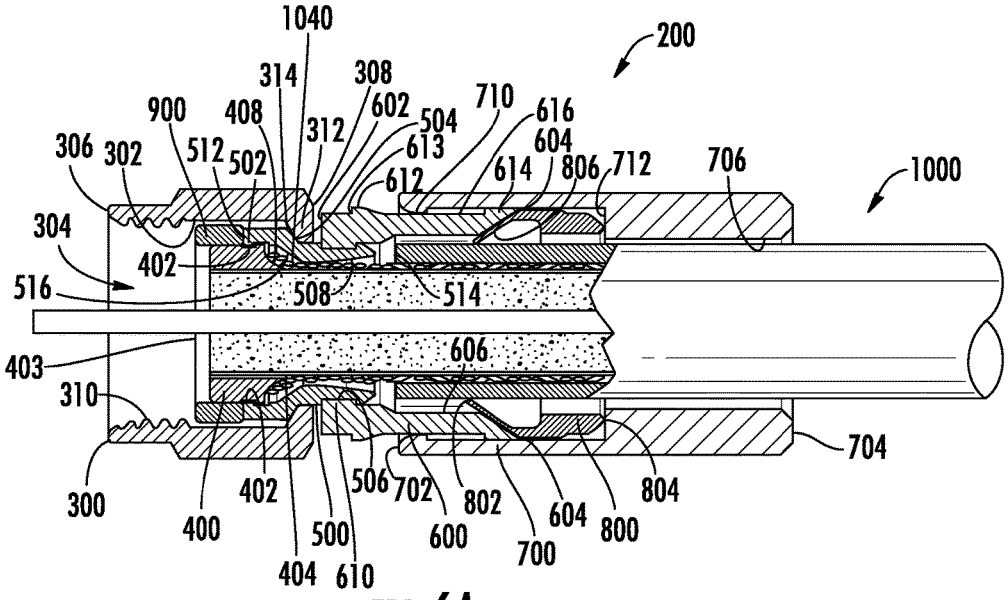
FIG. 6A schematically depicts a cross sectional view of the example coaxial cable connector depicted in FIG. 3 with a coaxial cable fully inserted therein and the connector partially compressed according to one or more embodiments described and illustrated herein.

FIG. 6A schematically depicts a cross sectional view of the example coaxial cable connector 200 depicted in FIGS. 3-5 with a coaxial cable 1000 fully inserted therein and the connector 200 partially compressed. In this embodiment, the collar 700 is moved axially forward toward the front of connector 200, such as by means of one or more industry standard compression tools (not shown). As shown in FIG. 6A, the flange 710 of the collar 700 is slid along the outer surface 616 of the body 600 between the first forward shoulder 612 and the second rearward shoulder 614. The gripping member 800 is driven at least partially inside body 600 by the axial movement of the radially inwardly extending surface 712 of the collar 700, such as also described in U.S. Pat. No. 7,182,639 previously incorporated by reference.

Figure 6B:
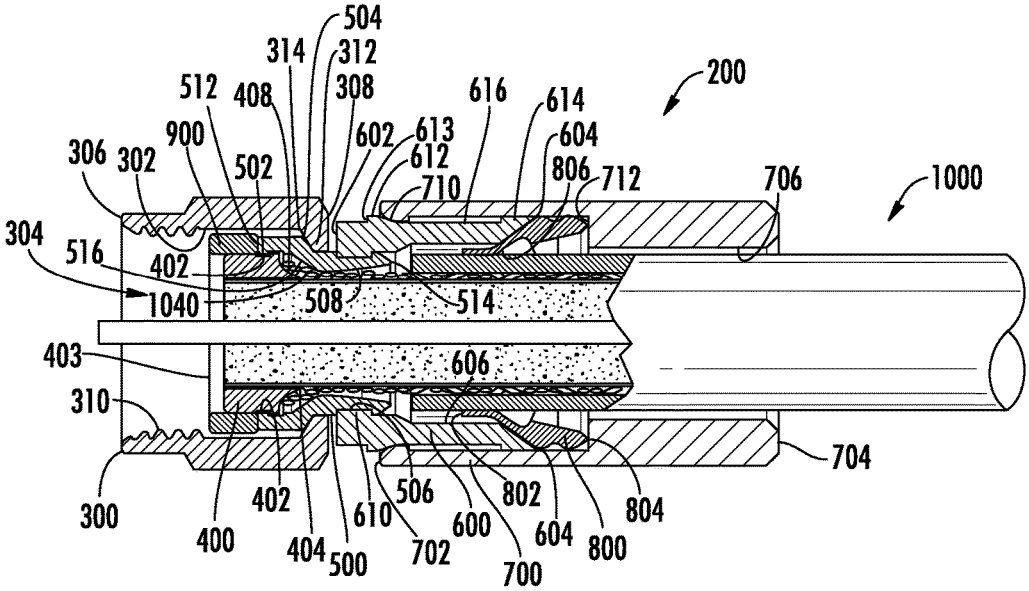
FIG. 6B schematically depicts a cross sectional view of the example coaxial cable connector depicted in FIG. 3 with a coaxial cable fully inserted therein and the connector further partially compressed according to one or more embodiments described and illustrated herein.

FIG. 6B schematically depicts a cross sectional view of the example coaxial cable connector 200 depicted in FIGS. 3-6A with the coaxial cable 1000 fully inserted therein and the connector 200 further partially compressed. In FIG. 6B, the collar 700 is moved further axially forward toward the front of connector 200, again such as by means of one or more industry standard compression tools (not shown). In this example, the flange 710 of the collar 700 is slid up to the first forward shoulder 612 along the outer surface 616 of the body 600. As shown in FIG. 6B, the gripping member 800 is driven at least partially under body 600 by the axial movement of collar 700.

Figure 6C:
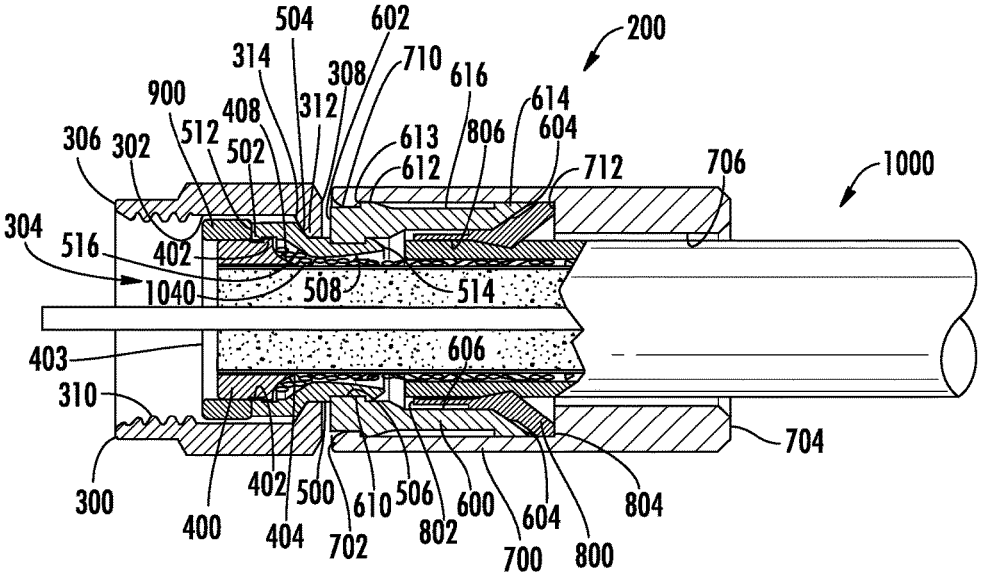
FIG. 6C schematically depicts a cross sectional view of the example coaxial cable connector depicted in FIG. 3 with a coaxial cable fully inserted therein and the connector even further partially compressed according to one or more embodiments described and illustrated herein.

FIG. 6C schematically depicts a cross sectional view of the example coaxial cable connector 200 depicted in FIGS. 3-6B with a coaxial cable 1000 fully inserted therein and connector 200 even further partially compressed. In FIG. 6C, the collar 700 is moved yet further axially forward toward the front of connector 200, again such as by means of one or more industry standard compression tools (not shown). In FIG. 6C, the flange 710 of the collar 700 has been slid over the first forward shoulder 612 of the body and snapped or otherwise latched or engaged with the forward facing surface 613 of the first forward shoulder 612 of the body 600 to engage the collar 700 and body 600 in the compressed state shown in FIG. 6C. The gripping member 800 is driven as far as possible by collar 700 and at least partially under the body 600 by the axial movement of the collar 700 and engages the outer layer of the coaxial cable.

FIG. 7 schematically depicts a cross sectional view of the example coaxial cable connector 200 depicted in FIGS. 3-6C with a coaxial cable fully inserted therein and the connector 200 fully compressed. As shown in FIG. 7, the retainer 400 is driven further inside of the hub 500 trapping and compressing the braided outer conductor layer 1040 between the retainer 400 and the hub 500. The entrapment and compression of the braided outer conductor layer 1040 betwixt the generally opposing angled surfaces 408 and 516 of the retainer 400 and the hub 500, respectively, causes both electrical conduction and mechanical communication between the connector and the coaxial cable braided outer conductor structure 1050. Electrically, a reliable ground path is established between the connector interface and the cable while simultaneously mechanical retention of the cable within the connector is achieved.

In the particular embodiment shown in FIGS. 3-7, for example, the retainer 400 and hub 500 each comprise generally opposing angled surfaces 408 and 516 of the retainer 400 and hub 500, respectively. The generally opposing angled surfaces 408 and 516 together define a gap disposed between the surfaces 408 and 516 of the retainer 400 and hub 500, respectively. The generally opposing angled surfaces 408 and 516 are configured to receive and engage an outer conductor layer (e.g., braided outer conductor layer) of a prepared end of a coaxial cable inserted into the coaxial cable connector 200 within the gap and, as the retainer 400 is moved axially closer to the hub 500 (e.g., via a compression tool), the surfaces 408 and 516 reduce the size of the gap disposed between the surfaces of the retainer 400 and hub 500 and engage the outer conductor structure 1040 providing electrical and/or mechanical engagement between the outer conductor 1040 of the coaxial cable 1000 and the retainer 400 and/or hub 500 of the coaxial cable connector 200.

In FIG. 7, the retainer 400 is shown driven further inside the hub 500 such that the flange 502 of the hub 500 is pushed forward of the groove 402 of the retainer 400 and is pushed forward into and, in some embodiments, compressing the gasket 900 to provide a seal between the hub 500 and the gasket 900.

Figure 8:
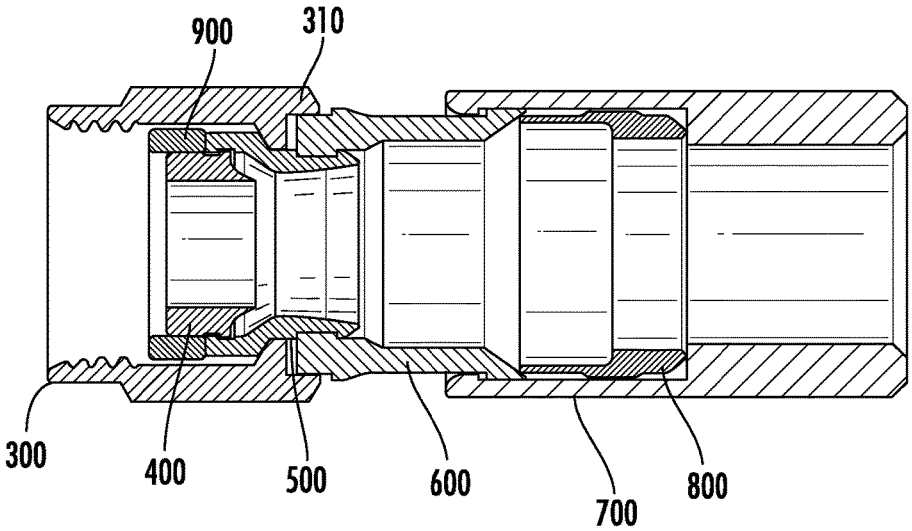
FIG. 8 schematically depicts a cross sectional view of another example coaxial cable connector providing an alternative coupling nut configuration according to one or more embodiments described and illustrated herein.

FIG. 8 schematically depicts a cross sectional view of an example coaxial cable connector providing an alternative coaxial cable connector configuration. In this embodiment, the coupler 300 of the coaxial cable connector further comprises an extended portion 310 that encircles at least a portion of body 600. Encirclement of the extended portion 310 of the coupler about body 600 increases the connector resistance to side-loading forces by reinforcing the mechanical joint between hub 500 and body 600.

Figure 9:
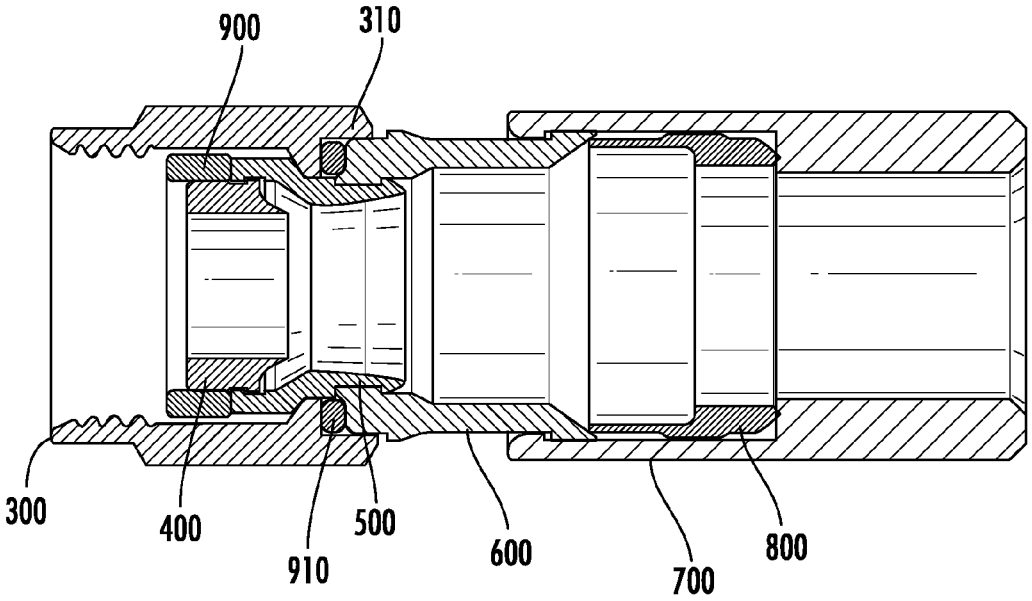
FIG. 9 schematically depicts a cross sectional view of yet another example coaxial cable connector providing an alternative coupling nut configuration and an O-ring according to one or more embodiments described and illustrated herein.
Figure 10:
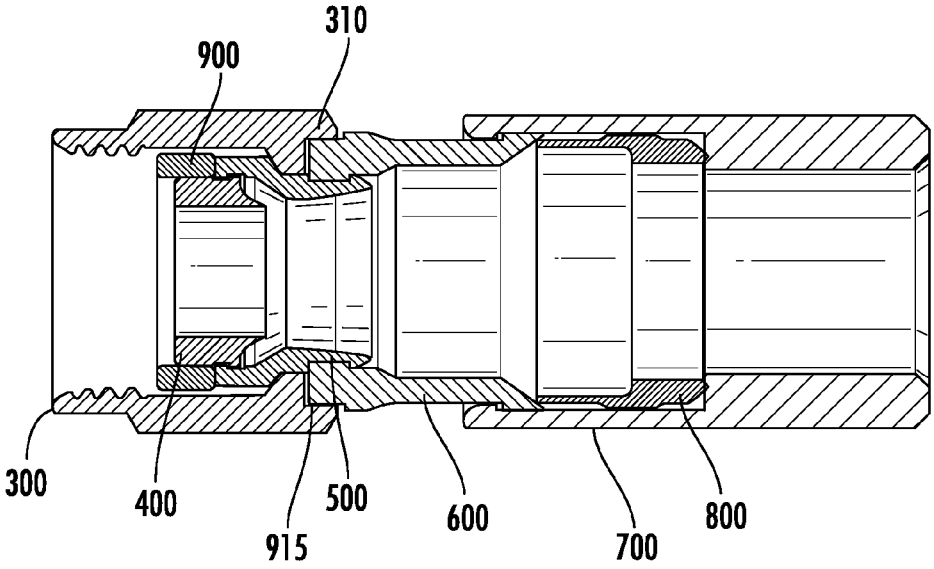
FIG. 10 schematically depicts a cross sectional view of another example coaxial cable connector providing an alternative coupling nut configuration and a body comprising an integral sealing feature according to one or more embodiments described and illustrated herein.

FIG. 9 schematically depicts a cross sectional view of another example coaxial cable connector providing the alternative coupling nut configuration as described with reference to FIG. 8 and further comprises an O-ring 910 disposed between a rearward facing edge of the inwardly extending flange of the coupler 300 and a front facing inwardly extending face of the body 500 disposed at or near the front end 502 of the body 500. Examples of such an O-Ring configuration are further described in United States published patent application number 2011/0250789 filed on Apr. 11, 2011, which is incorporated by reference herein in its entirety FIG. 10 schematically depicts a cross sectional view of yet another example coaxial cable connector providing the alternative coupler 300 configuration as described with reference to in FIG. 8. The coaxial cable connector and further comprises a body 600 having an integral sealing feature 915. In this embodiment, the integral sealing feature 915 includes a protrusion that provides an environmental seal with the counter bore of coupler 300, such as in embodiments wherein body 600 is made from a plastic material.

Figure 11:
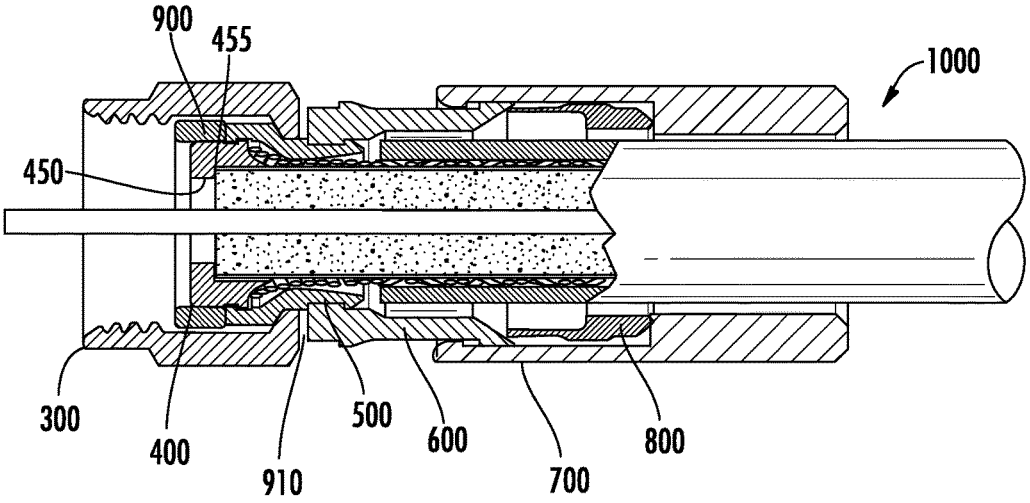
FIG. 11 schematically depicts a cross sectional view of yet another example coaxial cable connector comprising a conductive retainer having an alternative internal lip configuration according to one or more embodiments described and illustrated herein.

FIG. 11 schematically depicts a cross sectional view of another example coaxial cable connector. In this embodiment, the coaxial cable connector comprises a conductive retainer having an alternative internal lip 450. A rearward facing annular surface 455 of the internal lip 450 acts as a stop or seat to locate a cable core (including an inner conductor 1010, an insulator layer 1020 and metallic covering 1030) at a predetermined position making it possible to have cables of various structures (such as 60% braid, tri-shield and quad-shield cables) be located at a specific distance from the connector interface. The inner bore of retainer 400 may be adjusted to control the electrical impedance as related to cable center conductor 1010 to tune the connector interface for various electrical performance parameters.

Figure 12:
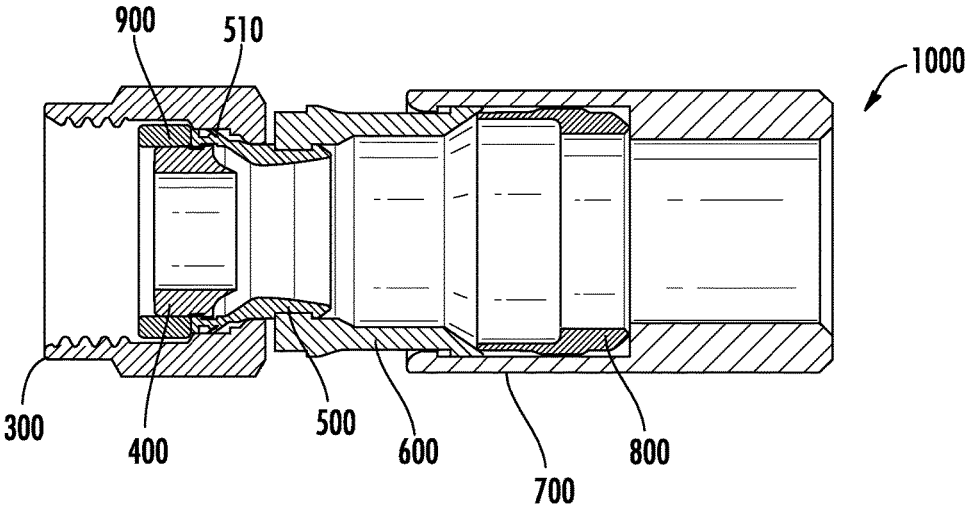
FIG. 12 schematically depicts a cross sectional view of another example coaxial cable connector comprising a hub having an integral continuity feature according to one or more embodiments described and illustrated herein.

FIG. 12 schematically depicts a cross sectional view of another example coaxial cable connector. In this embodiment, the coaxial cable connector comprises a hub 500 having an integral continuity feature 510. Such an integral continuity feature may include one or more integral continuity features such as described in U.S. patent application Ser. No. 13/652,969 filed on Oct. 16, 2012, which is incorporated by reference in its entirety as if fully set forth herein.

Figure 13:
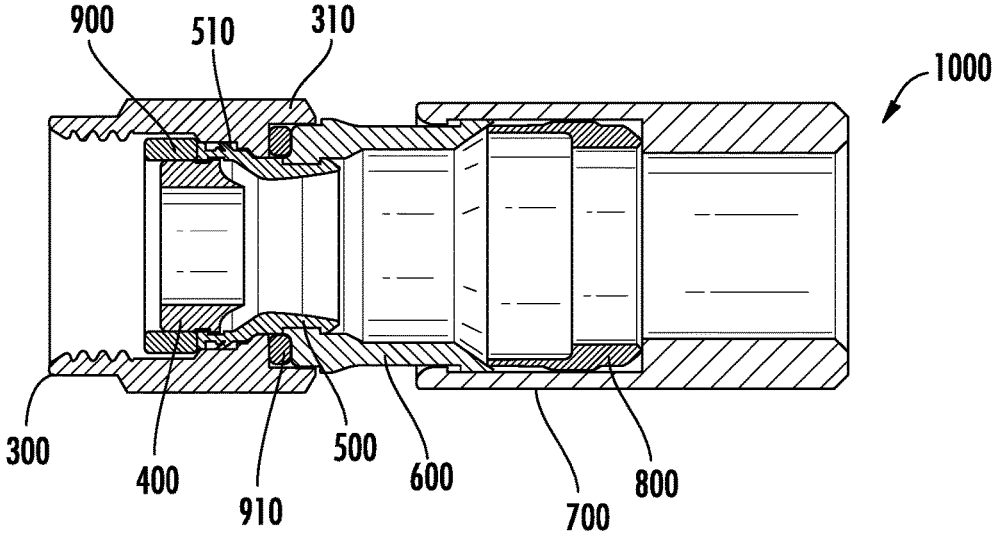
FIG. 13 schematically depicts a cross sectional view of yet another example coaxial cable connector comprising a hub having an integral continuity feature and further comprising an alternative coupling nut configuration and an O-ring according to one or more embodiments described and illustrated herein.

FIG. 13 schematically depicts a cross sectional view of yet another example coaxial cable connector. In this embodiment, the coaxial cable connector comprises a modified hub 500 structure including an integral continuity feature 510 and further comprising an alternative coupling nut configuration 310 and O-ring 910 as previously described with reference to FIG. 9.

Figure 14:
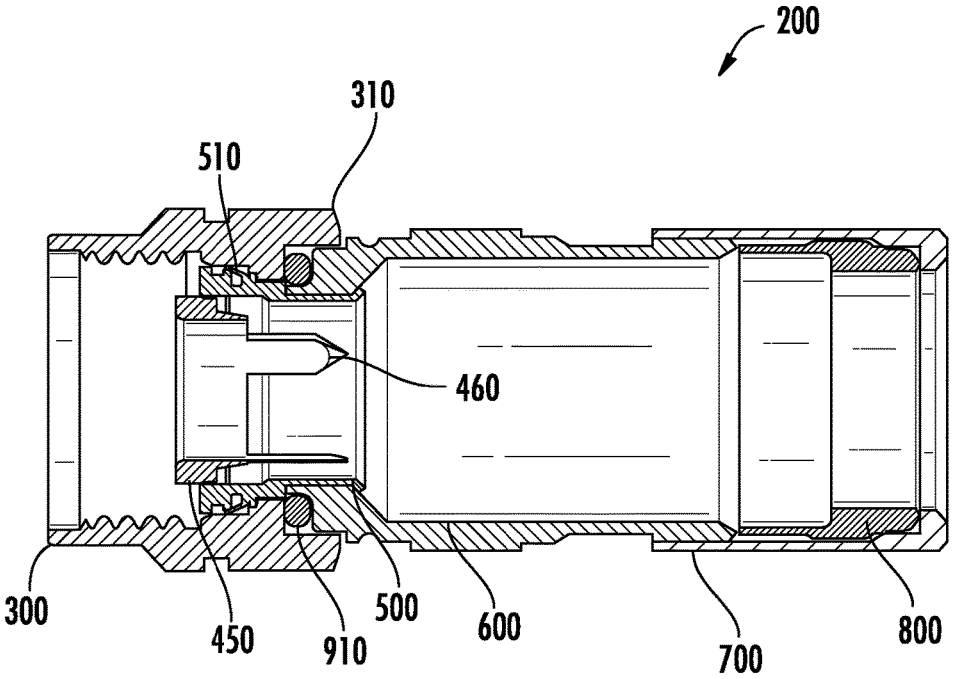
FIG. 14 schematically depicts a cross sectional view of another example coaxial cable connector comprising a conductive retainer including a protrusion member extending from the retainer and interposed in an end-wise fashion between a foil outer conductor layer of a coaxial cable and a braided outer conductive grounding sheath according to one or more embodiments described and illustrated herein.

FIG. 14 schematically depicts a cross sectional view of another example coaxial cable connector. In this embodiment, the coaxial cable connector comprises a conductive retainer 450 having a protrusion member 460 extending from and as part of the retainer 450. The protrusion member 460 is interposed in an end-wise fashion between the foil outer conductor layer 1030 of the coaxial cable 1000 and the braided outer conductive grounding sheath 1040 as illustrated in FIG. 15.

Figure 15:
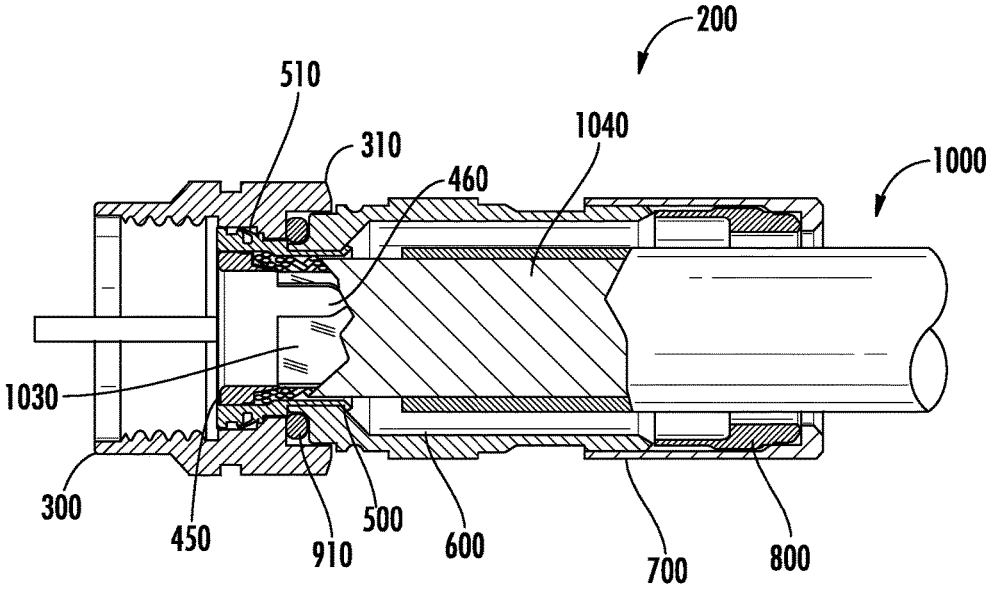
FIG. 15 schematically depicts a cross sectional view of the example coaxial cable connector of FIG. 14 having a coaxial cable at least partially installed according to one or more embodiments described and illustrated herein.

FIG. 15 schematically depicts a partial cross sectional view of the example coaxial cable connector of FIG. 14. The coaxial cable connector comprises a conductive retainer 450 having protrusion member 460 extending from and as part of retainer 450. The conductive retainer 450 is interposed in an end-wise fashion between the foil outer conductor layer 1030 of the coaxial cable 1000 and the braided outer conductive grounding sheath 1040.

Figure 16A:
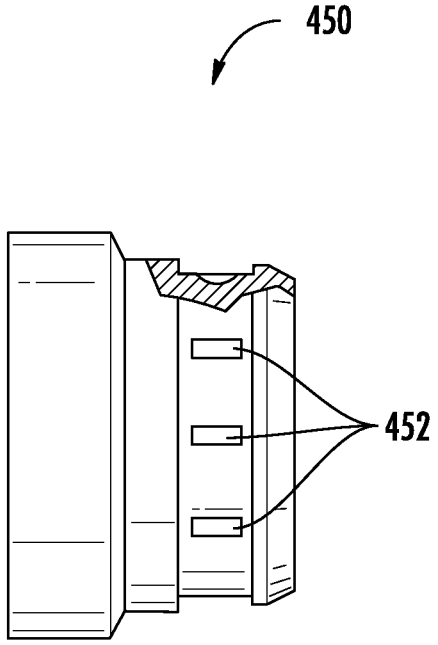
FIG. 16A schematically depicts a partial cross sectional view of an example hub configured to prevent or impede rotation within a mating body according to one or more embodiments described and illustrated herein.

FIG. 16A schematically depicts a partial cross sectional view of an example hub 450. In this embodiment, the hub 450 comprises a plurality of blind slots 452 disposed along an outer edge of the hub 450. The blind slots 452 are configured to prevent or impede rotation of hub 450 within body 600. In this embodiment, the edges of the slots 452 are configured to engage the inner bore of body 600, such as in embodiments where body 600 is made from a plastic material.

Figure 16B:
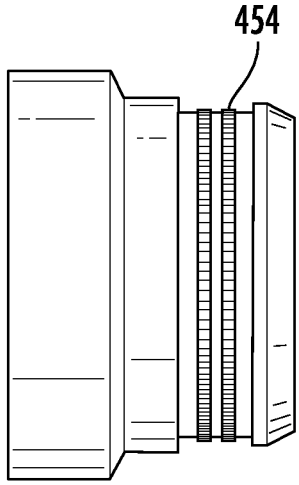
FIG. 16B schematically depicts an external view of an another example hub configured to prevent or impeded rotation within a mating body according to one or more embodiments described and illustrated herein.

FIG. 16B schematically depicts an external view of another example hub 450. In this embodiment, the hub 450 is configured to prevent or impede rotation of the hub 450' within the body 600 via a knurled surface 454. Teeth of the knurled surface 454 are configured to engage the inner bore of body 600, such as in embodiments wherein body 600 is made from a plastic material.

Figure 17A:
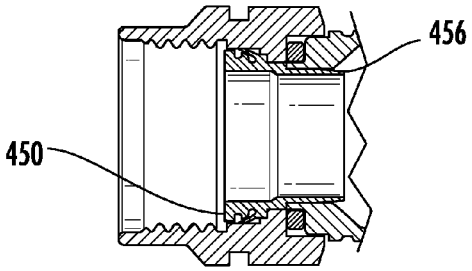
FIG. 17A schematically depicts a partial cross sectional view of an example hub mounted within a mating body of a coaxial cable connector according to one or more embodiments described and illustrated herein.
Figure 17C:
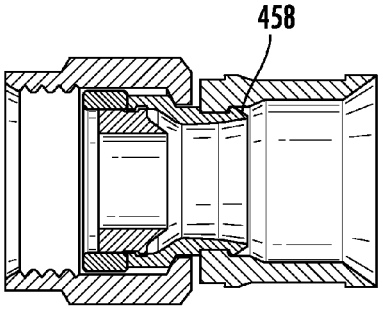
FIG. 17C schematically depicts a partial cross sectional view of another example hub mounted within a mating body of a coaxial cable connector according to one or more embodiments described and illustrated herein.
Figure 17B:
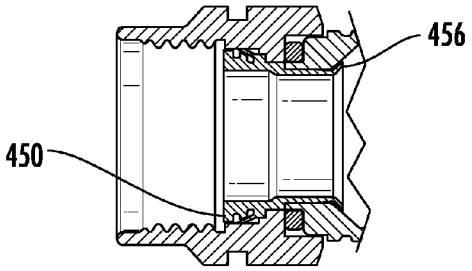
FIG. 17B schematically depicts a partial cross sectional view of the example hub depicted in FIG. 17A mounted within a mating body of the coaxial cable connector and having an end flared according to one or more embodiments described and illustrated herein.

FIGS. 17A and 17B schematically depict partial cross sectional views of an example hub 450 mounted within a body 600. In FIG. 17A, the hub 450 is in a pre-flared condition such that the rear end 456 of the hub 450 extends generally longitudinally through a front opening of the body 600. In FIG. 17B, the hub 450 is mounted within body 600 and the hub 450 is in a flared condition 45*x*. In this embodiment, the flared rear end 456 serves to interlock hub 450 with body 600 for improved component retention.

Figure 17D:
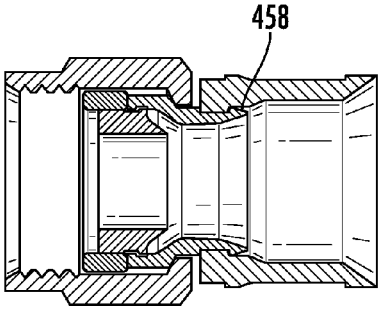
FIG. 17D schematically depicts a partial cross sectional view of the example hub depicted in FIG. 17C mounted within a mating body of a coaxial cable connector and having an end flared according to one or more embodiments described and illustrated herein.

FIGS. 17C and 17D schematically depict partial cross sectional views of another example hub 450 mounted within a body 600. In FIG. 17C, the hub 450 at least partially comprises a barb 458 and is in a pre-flared condition. In FIG. 17D, the hub 450 is mounted within body 600. The hub 450 is in a flared condition 458. The flare 458 serves to interlock hub 450 with the body 600 for improved component retention.

Figure 18:
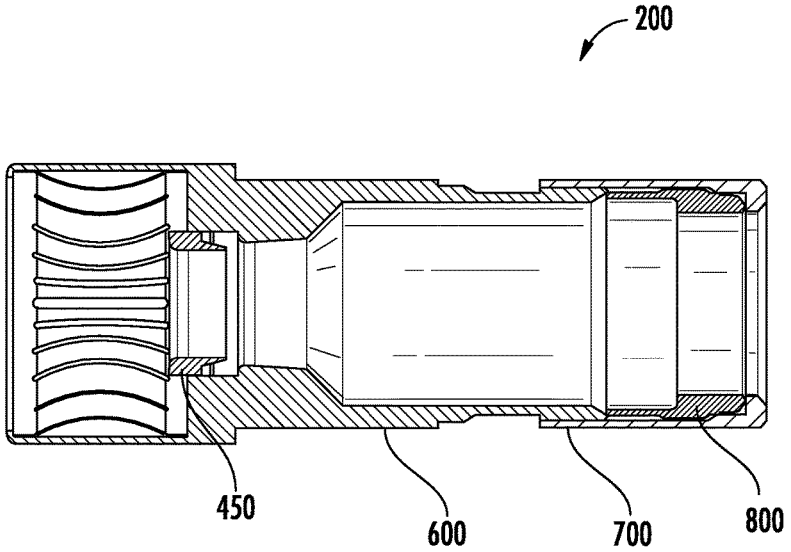
FIG. 18 schematically depicts a cross sectional view of yet another example coaxial cable connector at least partially comprising a push-on type connector interface configured to engage a mating port without the use of a rotatable coupler according to one or more embodiments described and illustrated herein.

FIG. 18 schematically depicts a cross sectional view of yet another example coaxial cable connector 200. In this embodiment, the coaxial cable connector 200 at least partially comprises a push-on type connector interface incorporated to engage a mating port without the use of a rotatable coupler.

Figure 19:
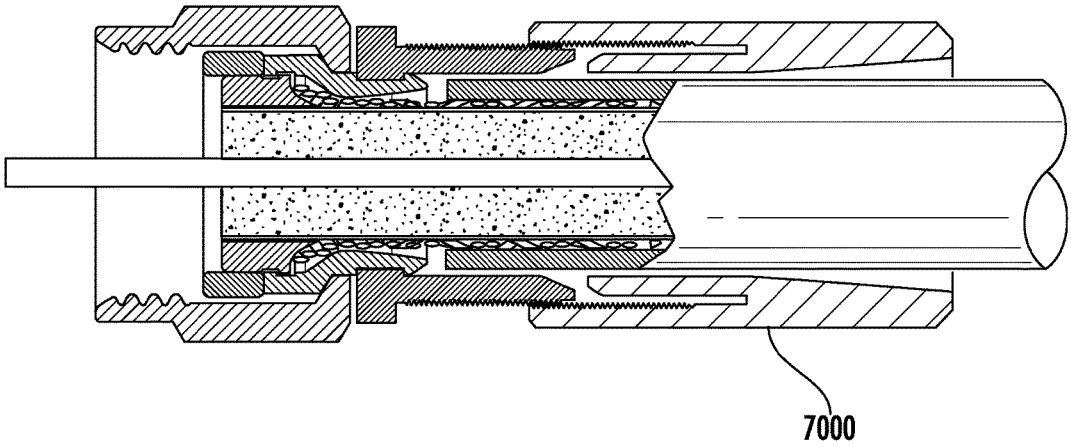
FIG. 19 schematically depicts a cross sectional view of another example coaxial cable connector at least partially comprising a unitary rear collar according to one or more embodiments described and illustrated herein.

FIG. 19 schematically depicts a cross sectional view of another example coaxial cable connector. In this embodiment, the coaxial cable connector at least partially comprises a unitary rear collar 7000 in an open or uncompressed condition having a coaxial cable inserted. Examples of such a rear collar are provided in U.S. Pat. No. 5,879,191, which is incorporated by reference in its entirety as if fully set forth herein.

Figure 20:
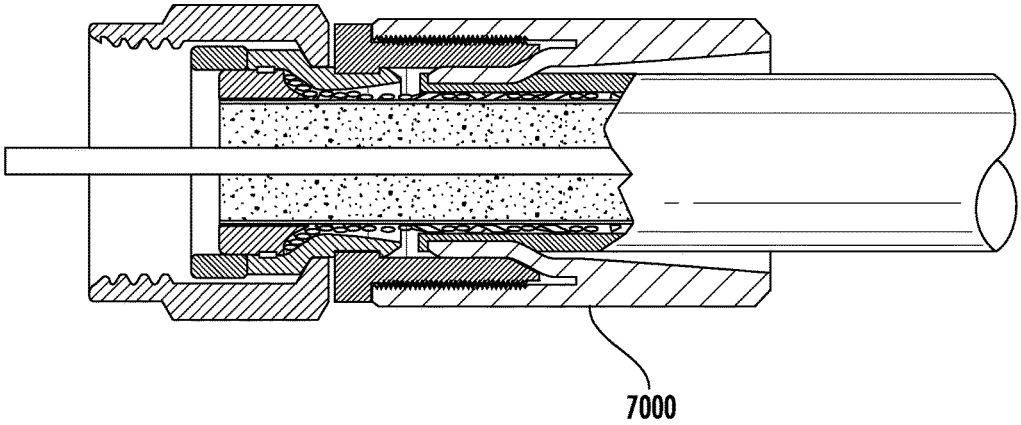
FIG. 20 schematically depicts a cross sectional view of the example coaxial cable connector depicted in FIG. 19 with a coaxial cable partially inserted therein according to one or more embodiments described and illustrated herein.

FIG. 20 schematically depicts a cross sectional view of the example coaxial cable connector at least partially comprising a unitary rear collar 7000 as depicted in FIG. 19 with a coaxial cable inserted and the connector in a closed or compressed condition. Again, examples of unitary rear collars that may be provided in a coaxial cable connector such as shown in FIG. 20 are provided in previously incorporated U.S. Pat. No. 5,879,191.

Figure 21:
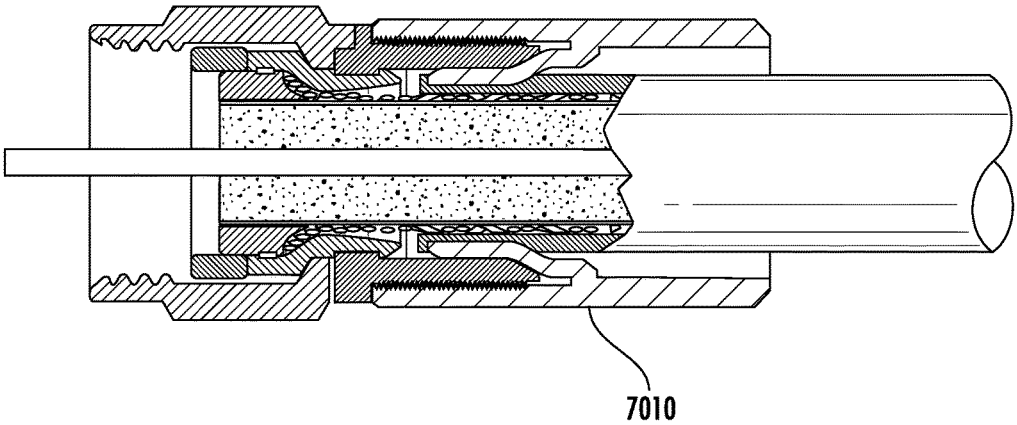
FIG. 21 schematically depicts a cross sectional view of another example coaxial cable connector at least partially comprising a unitary rear collar having a hinged portion according to one or more embodiments described and illustrated herein.

FIG. 21 schematically depicts a cross sectional view of another example coaxial cable connector at least partially comprising a unitary rear collar 7000 having a hinged portion similar to that as disclosed in previously incorporated U.S. Pat. No. 5,879,191 with a coaxial cable inserted and the connector in a closed or compressed condition.

It should now be understood that embodiments described herein are directed to connectors and methods for securing an outer layer of a cable or conduit within a connector.

For the purposes of describing and defining the subject matter of the disclosure it is noted that the terms "substantially" and "generally" are utilized herein to represent the inherent degree of uncertainty that may be attributed to any quantitative comparison, value, measurement, or other representation.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the disclosure. Since modifications, combinations, sub-combinations and variations of the disclosed embodiments incorporating the spirit and substance of the disclosure may occur to persons skilled in the art, the embodiments disclosed herein should be construed to include everything within the scope of the appended claims and their equivalents.

What is claimed is:

1. A coaxial cable connector for connecting a coaxial cable comprising an inner conductor, an insulator layer surrounding the inner conductor, an outer conductor layer surrounding the insulator layer, and an outer jacket, the coaxial cable connector comprising:

a coupler;

a retainer;

a hub; and a body, wherein the coupler comprises an inner surface defining a coupler inner bore, the retainer is disposed inside the hub within the coupler inner bore and comprises a first forward end, a second rearward end, an inner surface defining a retainer inner bore configured to receive the inner conductor and the insulator layer of a prepared end of the coaxial cable, and an angled rear facing surface configured to extend between the insulator layer and the outer conductor layer of the coaxial cable, the hub is engaged with the retainer and disposed at least partially within the inner bore of the coupler, the hub rotatably engaged with the coupler and further comprising a first forward end, a second rear end, and an angled forward facing surface opposing the angled rear facing surface of the retainer to define a gap between the angled rear facing surface of the retainer and the angled forward facing surface of the hub, the first forward end of the hub is rearward of the first forward end of the retainer and the gap between angled rear facing surface of the retainer and the angled forward facing surface of the hub is disposed within the coupler inner bore, the body comprises a forward end, a rear end, and an inner surface defining an inner bore extending longitudinally between the forward end and the rear end, the body is disposed at least partially radially externally to a rearward portion of the hub and engages the hub at the forward end, the inner bore is configured to receive the prepared end of the coaxial cable, the retainer is configured to be driven inside of the hub to trap and compress the outer conductor layer of the coaxial cable in the gap between the angled rear facing surface of the retainer and the angled forward facing surface of the hub, and the angled rear facing surface of the retainer and the angled forward facing surface of the hub are configured to secure the outer conductor layer of the coaxial cable between the angled rear facing surface of the retainer and the angled forward facing surface of the hub.

2. A coaxial cable connector for connecting a coaxial cable comprising an inner conductor, an insulator layer surrounding the inner conductor, an outer conductor layer surrounding the insulator layer, and an outer jacket, wherein the coaxial cable connector comprises:

a coupler comprising an inner surface defining a coupler inner bore;

a retainer comprising an inner surface defining a retainer inner bore configured to receive the inner conductor and the insulator layer of a coaxial cable and an angled rear facing surface configured to extend between the insulator layer and the outer conductor layer of the coaxial cable, the retainer disposed within the inner bore of the coupler;

a hub engaged to the retainer and disposed at least partially within the inner bore of the coupler, the hub rotatably engaged with the coupler, the hub further comprising an angled forward facing surface at least partially opposing the angled rear facing surface of the retainer;

a body comprising a forward end, a rear end and an inner surface defining a body inner bore extending longitudinally between the forward end and the rear end, the body engaged to the hub generally at the forward end of the body, wherein the angled rear facing surface of the retainer and the angled forward facing surface of the hub are configured to secure the outer conductor layer between the angled rear facing surface of the retainer and the angled forward facing surface of the hub;

a collar comprising a forward end and a rear end and an inner surface defining a collar inner bore, the collar disposed at least partially outside the body and configured to move axially with respect to the body; and a gripping member disposed within the collar inner bore at least partially adjacent to the rear end of the body.

3. The connector of claim 2 wherein the body comprises a first forward shoulder, a second rear shoulder and an outer surface extending between the first forward shoulder and the second rear shoulder, the first forward shoulder and second rear shoulder extending radially outwardly from the outer surface.

4. The connector of claim 3 wherein the collar comprises an inwardly extending flange disposed between the first forward shoulder and the second rear shoulder.

5. The connector of claim 4 wherein the collar is configured to slide longitudinally with respect to the body with the inwardly extending flange of the collar disposed between the first forward shoulder and second rear shoulder of the body.

6. The connector of claim 5 wherein the collar comprises a surface extending inwardly from the inner surface of the collar into the collar inner bore, the gripping member disposed adjacent the surface.

7. The connector of claim 6 wherein the surface of the collar is configured to move the gripping member at least partially into the body when the collar is moved longitudinally toward the body.

8. The connector of claim 6 wherein the gripping member is adapted to secure the outer jacket of the coaxial cable within the body.

9. The connector of claim 1 wherein the retainer comprises an outer annular groove disposed along an outer surface of the retainer and the hub comprises an inwardly extending flange engaged with the outer annular groove of the retainer.

10. A coaxial cable connector for connecting a coaxial cable comprising an inner conductor, an insulator layer surrounding the inner conductor, an outer conductor layer surrounding the insulator layer, and an outer jacket, the coaxial cable connector comprising:

a coupler;

a retainer;

a hub; and a body, wherein the coupler comprises an inner surface defining a coupler inner bore, the retainer is disposed inside the hub within the coupler inner bore and comprises a first forward end, a second rearward end, an inner surface defining a retainer inner bore configured to receive the inner conductor and the insulator layer of a prepared end of the coaxial cable, and an angled rear facing surface configured to extend between the insulator layer and the outer conductor layer of the coaxial cable, the hub is engaged with the retainer and disposed at least partially within the inner bore of the coupler, the hub rotatably engaged with the coupler the hub and further comprising a first forward end, a second rear end, and an angled forward facing surface at least partially opposing the angled rear facing surface of the retainer to define a gap between the angled rear facing surface of the retainer and the angled forward facing surface of the hub, the first forward end of the hub is rearward of the first forward end of the retainer and the gap between angled rear facing surface of the retainer and the angled forward facing surface of the hub is disposed within the coupler inner bore, the body is disposed at least partially radially externally to a rearward portion of the hub and comprises an inner bore configured to receive the prepared end of the coaxial cable, the retainer is configured to be driven inside of the hub to trap and compress the outer conductor layer of the coaxial cable in the gap between the angled rear facing surface of the retainer and the angled forward facing surface of the hub, the angled rear facing surface of the retainer and the angled forward facing surface of the hub are configured to secure the outer conductor layer of the coaxial cable between the angled rear facing surface of the retainer and the angled forward facing surface of the hub, and the connector comprises an O ring disposed between the coupler and body.

11. A coaxial cable connector for connecting a coaxial cable comprising an inner conductor, an insulator layer surrounding the inner conductor, an outer conductor layer surrounding the insulator layer, and an outer jacket, the coaxial cable connector comprising:

a coupler;

a retainer;

a hub; and a body, wherein the coupler comprises an inner surface defining a coupler inner bore, wherein an extended portion of the coupler at least partially encircles a portion of the body, the retainer is disposed inside the hub within the coupler inner bore and comprises a first forward end, a second rearward end, an inner surface defining a retainer inner bore configured to receive the inner conductor and the insulator layer of a prepared end of the coaxial cable, and an angled rear facing surface configured to extend between the insulator layer and the outer conductor layer of the coaxial cable, the hub is engaged with the retainer and disposed at least partially within the inner bore of the coupler, the hub rotatably engaged with the coupler the hub and further comprising a first forward end, a second rear end, and an angled forward facing surface at least partially opposing the angled rear facing surface of the retainer to define a gap between the angled rear facing surface of the retainer and the angled forward facing surface of the hub, the first forward end of the hub is rearward of the first forward end of the retainer and the gap between angled rear facing surface of the retainer and the angled forward facing surface of the hub is disposed within the coupler inner bore, the body is disposed at least partially radially externally to a rearward portion of the hub and comprises an inner bore configured to receive the prepared end of the coaxial cable, the retainer is configured to be driven inside of the hub to trap and compress the outer conductor layer of the coaxial cable in the gap between the angled rear facing surface of the retainer and the angled forward facing surface of the hub, and the angled rear facing surface of the retainer and the angled forward facing surface of the hub are configured to secure the outer conductor layer of the coaxial cable between the angled rear facing surface of the retainer and the angled forward facing surface of the hub.

12. The connector of claim 1 wherein the hub comprises an integral continuity element.

13. The connector of claim 1 wherein the retainer comprises a protrusion extending from the retainer, the protrusion configured to be interposed between the insulator layer and the outer conductor layer.

14. The connector of claim 1 wherein the hub comprises a plurality of slots each having at least two edges, the edges configured to frictionally engage the inner surface of the body.

15. The connector of claim 1 wherein the hub comprises at least one barb configured to frictionally engage the inner surface of the body.

16. The connector of claim 1 wherein a rear end of the hub is flared to engage an inner surface of the body.

17. A method for securing a cable or conduit in a coaxial cable connector comprising a coupler, a retainer, a hub, a body, a collar, and a gripping member, wherein:

the coupler comprises an inner surface defining a coupler inner bore;

the retainer is disposed inside the hub within the coupler inner bore and comprises a first forward end, a second rearward end, an inner surface defining a retainer inner bore configured to receive the inner conductor and the insulator layer of a prepared end of the coaxial cable, and an angled rear facing surface configured to extend between the insulator layer and the outer conductor layer of the coaxial cable;

the hub is engaged with the retainer and disposed at least partially within the inner bore of the coupler, the hub rotatably engaged with the coupler and further comprising a first forward end, a second rear end, and an angled forward facing surface opposing the angled rear facing surface of the retainer to define a gap between the angled rear facing surface of the retainer and the angled forward facing surface of the hub;

the first forward end of the hub is rearward of the first forward end of the retainer and the gap between angled rear facing surface of the retainer and the angled forward facing surface of the hub is disposed within the coupler inner bore;

the body is disposed at least partially radially externally to a rearward portion of the hub and comprises an inner bore configured to receive the prepared end of the coaxial cable;

the retainer is configured to be driven inside of the hub to trap and compress the outer conductor layer of the coaxial cable in the gap between the angled rear facing surface of the retainer and the angled forward facing surface of the hub;

the angled rear facing surface of the retainer and the angled forward facing surface of the hub are configured to secure the outer conductor layer of the coaxial cable between the angled rear facing surface of the retainer and the angled forward facing surface of the hub;

the collar comprises a forward end and a rear end and an inner surface defining a collar inner bore, the collar disposed at least partially outside the body and configured to move axially with respect to the body;

the gripping member is disposed within the collar inner bore at least partially adjacent to the rear end of the body; and the method comprises (i) inserting a coaxial cable through inner bores of the collar, the gripping member, the body, and the hub, an inner conductor and insulator of the coaxial cable extending through the retainer and the outer conductor of the coaxial cable extending between the angled rear facing surface of the retainer and the angled forward facing surface of the hub and (ii) sliding the collar relative to the body, the collar comprising a surface extending inwardly from an inner surface of the collar, the surface disposed adjacent to and contacting a rear end of the gripping member, the collar surface pushing the gripping member at least partially into a rear end of the body.

18. The method of claim 17, wherein the body comprises a first forward shoulder, a second rear shoulder and an outer surface extending between the first forward shoulder and the second forward shoulder, the first forward shoulder and second rear shoulder extending radially outwardly from the outer surface.

19. The method of claim 18 wherein collar comprises an inwardly extending flange disposed between the first forward shoulder and the second rear shoulder.

20. The method of claim 19 wherein the collar is configured to slide longitudinally with respect to the body with the inwardly extending flange of the collar disposed between the first forward shoulder and second rear shoulder of the body.

21. A coaxial cable connector for connecting a coaxial cable comprising an inner conductor, an insulator layer surrounding the inner conductor, an outer conductor layer surrounding the insulator layer, and an outer jacket, the coaxial cable connector comprising:

a coupler;

a retainer;

a body; and a hub, wherein the coupler comprises an inner surface defining a coupler inner bore, the retainer is disposed inside the hub within the coupler inner bore and comprises a first forward end, a second rearward end, an inner surface defining a retainer inner bore configured to receive the inner conductor and the insulator layer of a prepared end of the coaxial cable, and an angled rear facing surface configured to extend between the insulator layer and the outer conductor layer of the coaxial cable, the hub is engaged with the retainer and disposed at least partially within the inner bore of the coupler, the hub rotatably engaged with the coupler and further comprising a first forward end, a second rear end, and an angled forward facing surface opposing the angled rear facing surface of the retainer to define a gap between the angled rear facing surface of the retainer and the angled forward facing surface of the hub, the first forward end of the hub is rearward of the first forward end of the retainer and the gap between angled rear facing surface of the retainer and the angled forward facing surface of the hub is disposed within the coupler inner bore, the body is disposed at least partially radially externally to a rearward portion of the hub and comprises an inner bore configured to receive the prepared end of the coaxial cable;

the retainer is configured to be driven inside of the hub to trap and compress the outer conductor layer of the coaxial cable in the gap between the angled rear facing surface of the retainer and the angled forward facing surface of the hub, and the angled rear facing surface of the retainer and the angled forward facing surface of the hub are configured to secure the outer conductor layer of the coaxial cable between the angled rear facing surface of the retainer and the angled forward facing surface of the hub.

* * * * *